US010994897B2

(12) United States Patent
Salcido Pinera

(10) Patent No.: US 10,994,897 B2
(45) Date of Patent: May 4, 2021

(54) SECURITY CLOSURE SYSTEM AND DEVICES FOR CONTAINERS

(71) Applicant: Juan Francisco Salcido Pinera, Tlalpan Ciudad de Mexico (MX)

(72) Inventor: Juan Francisco Salcido Pinera, Tlalpan Ciudad de Mexico (MX)

( * ) Notice: Subject to any disclaimer, the term of this patent is extended or adjusted under 35 U.S.C. 154(b) by 171 days.

(21) Appl. No.: 16/094,884

(22) PCT Filed: May 13, 2016

(86) PCT No.: PCT/MX2016/050006
§ 371 (c)(1),
(2) Date: Oct. 19, 2018

(87) PCT Pub. No.: WO2017/183952
PCT Pub. Date: Oct. 26, 2017

(65) Prior Publication Data

US 2019/0127121 A1 May 2, 2019

(30) Foreign Application Priority Data

Apr. 19, 2016 (MX) ..... MX/a/2016/005037

(51) Int. Cl.
*B65D 41/00* (2006.01)
*B65D 41/28* (2006.01)
(Continued)

(52) U.S. Cl.
CPC ..... *B65D 41/28* (2013.01); *B65D 41/00* (2013.01); *B65D 41/32* (2013.01); *B65D 41/34* (2013.01);
(Continued)

(58) Field of Classification Search
CPC ..... B65D 2401/50; B65D 2401/00; B65D 41/3457; B65D 41/28; B65D 41/00; B65D 41/32; B65D 41/34
(Continued)

(56) References Cited

U.S. PATENT DOCUMENTS

| | | | | |
|---|---|---|---|---|
| 5,328,044 A * | 7/1994 | Rohrs | ..... | B65D 41/3438 215/252 |
| 2004/0060891 A1* | 4/2004 | Nishida | ..... | B65D 41/3438 215/252 |
| 2011/0056904 A1 | 3/2011 | Rozenberg | | |

FOREIGN PATENT DOCUMENTS

| | | |
|---|---|---|
| ES | 236146 T3 | 6/2011 |
| ES | 2575791 T3 | 7/2016 |
| WO | 2004/033312 A2 | 4/2004 |

OTHER PUBLICATIONS

European Patent Office, NL; Jun. 23, 2017.

* cited by examiner

*Primary Examiner* — King M Chu
(74) *Attorney, Agent, or Firm* — Patshegen IP LLC; Moshe Pinchas

(57) ABSTRACT

The present invention relates to a security closure system and devices for containers, which can be used in any type of container and can be validated by means of simple sight and touch, thereby being tamper-resistant and preventing any adulteration by means of the non-authorised re-use of the original container. The system and devices are preferably used in containers made from vitreous materials such as ceramics, plastics and thermoplastics, owing to the properties of stiffness. The devices of the invention can be used for any product and any type of container, such as bottles for alcoholic and non-alcoholic drinks, containers for cosmet-
(Continued)

ics, perfumes, drugs, food and valuable items such as watches, electronics or fine jewelry.

12 Claims, 14 Drawing Sheets

(51) Int. Cl.
*B65D 41/34* (2006.01)
*B65D 41/40* (2006.01)
*B65D 50/00* (2006.01)
*B65D 41/32* (2006.01)

(52) U.S. Cl.
CPC ..... *B65D 41/40* (2013.01); *B65D 50/00* (2013.01); *B65D 2401/50* (2020.05); *B65D 2543/00296* (2013.01); *B65D 2543/00305* (2013.01)

(58) Field of Classification Search
USPC ..... 215/201, 252
See application file for complete search history.

[Fig. 1]
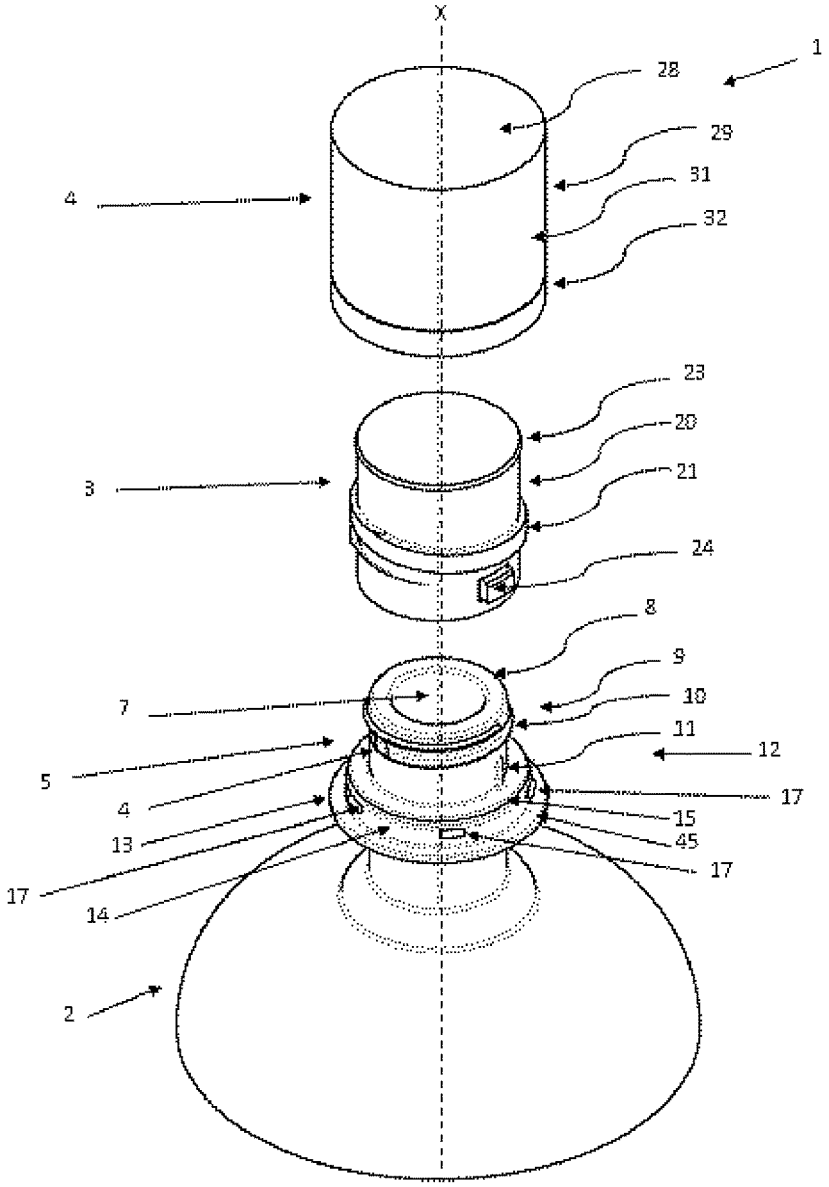
[Fig. 2]
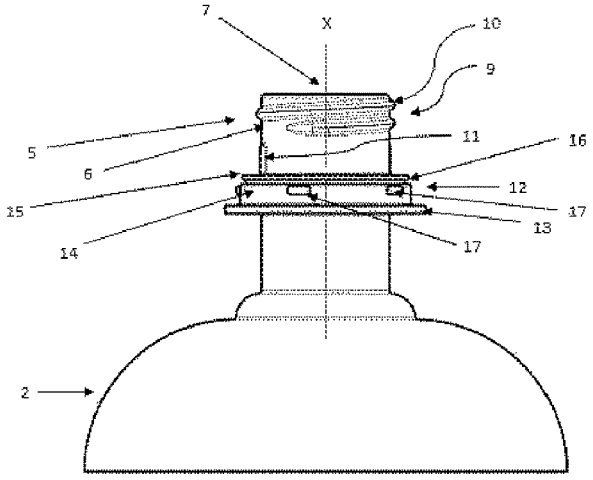

[Fig. 3]
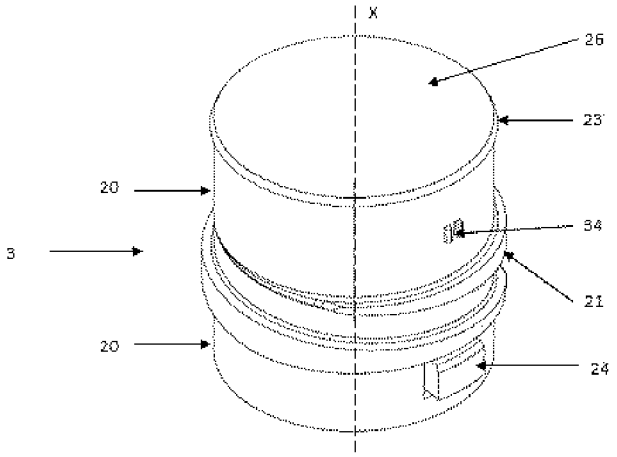
[Fig. 4]
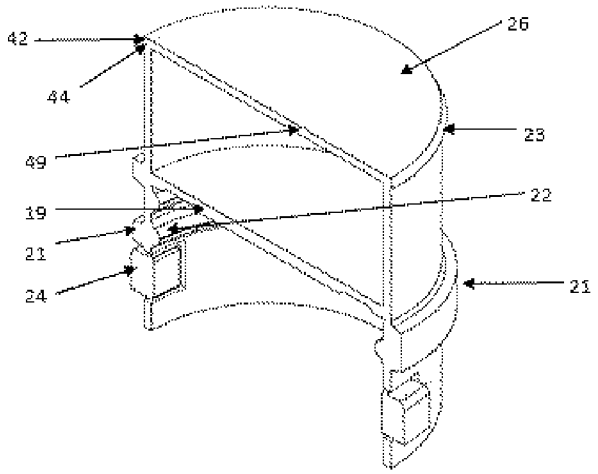
[Fig. 5]
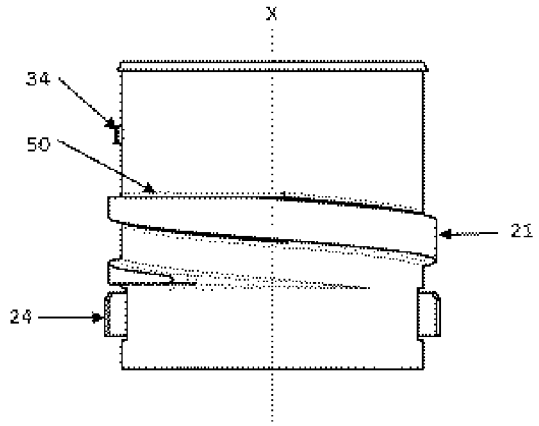

[Fig. 6]
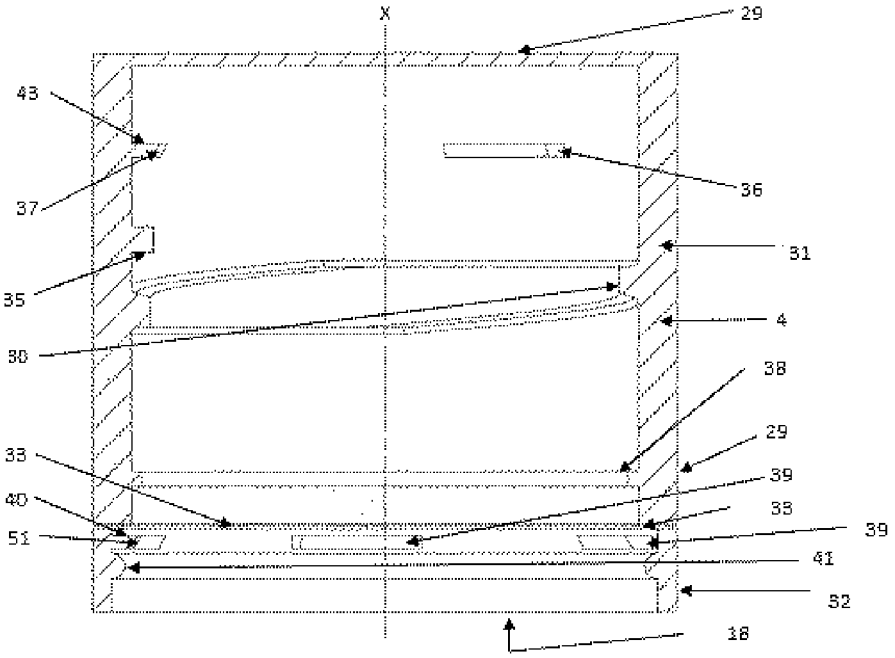
[Fig. 7]
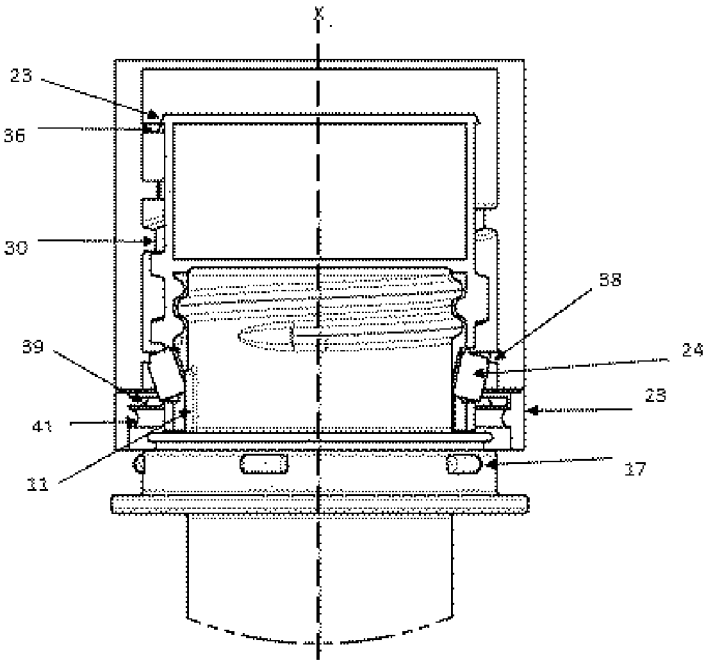

[Fig. 8]
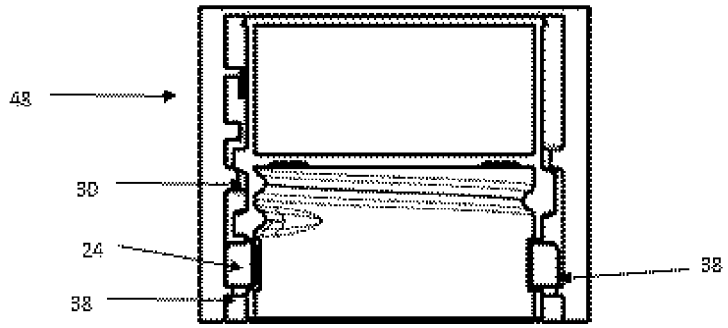
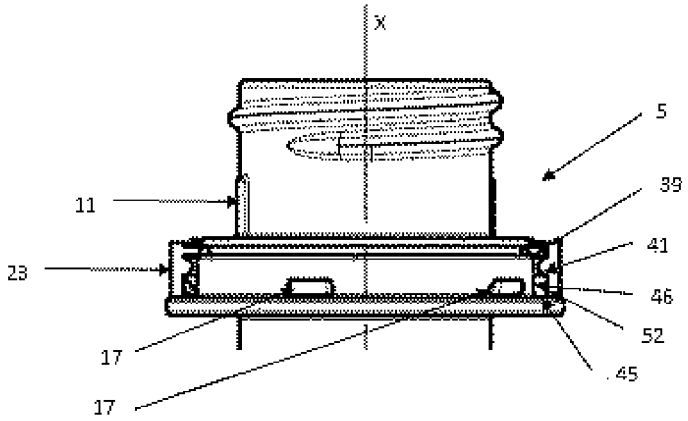
[Fig. 9]
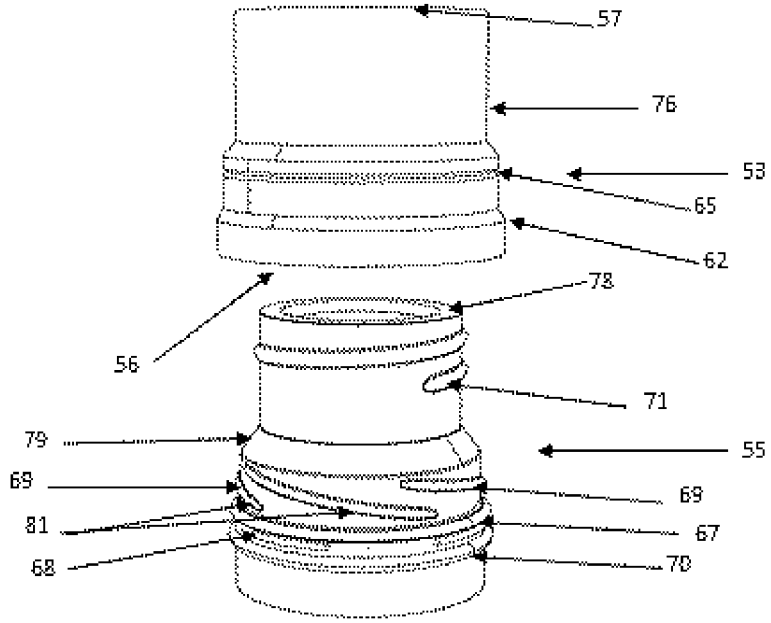

[Fig. 10]
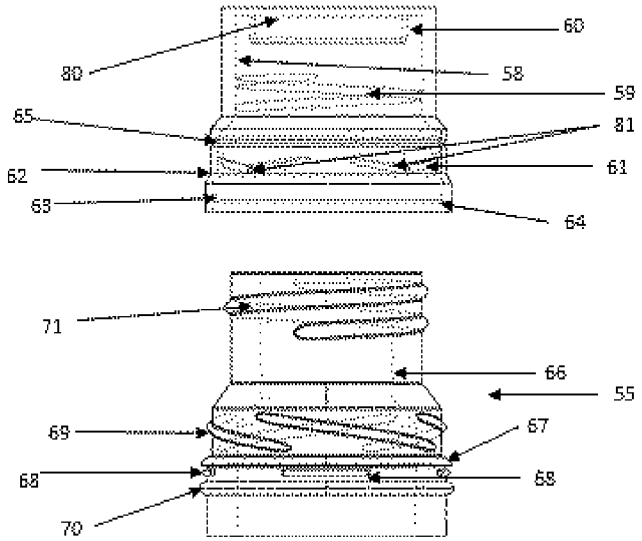
[Fig. 11]
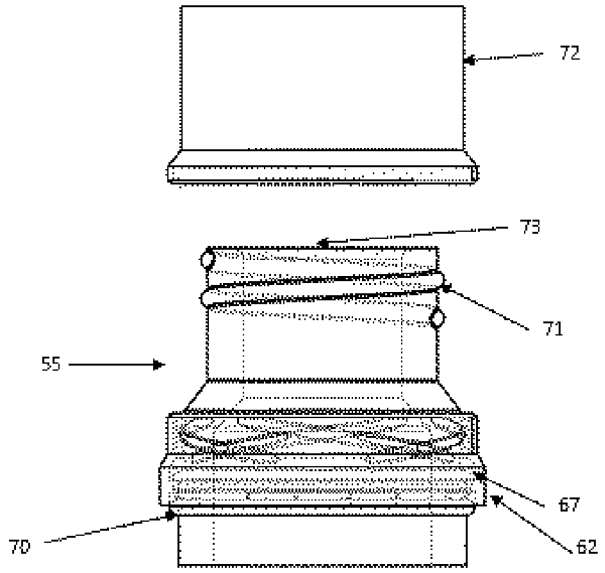
[Fig. 12]
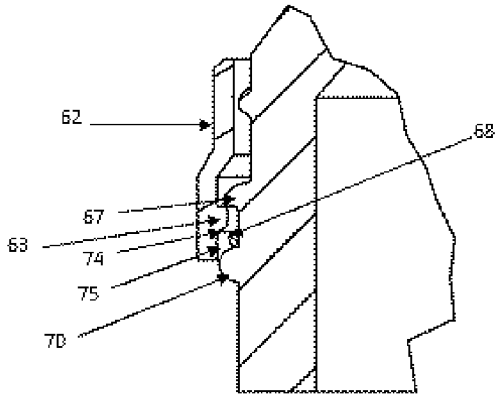

[Fig. 13]
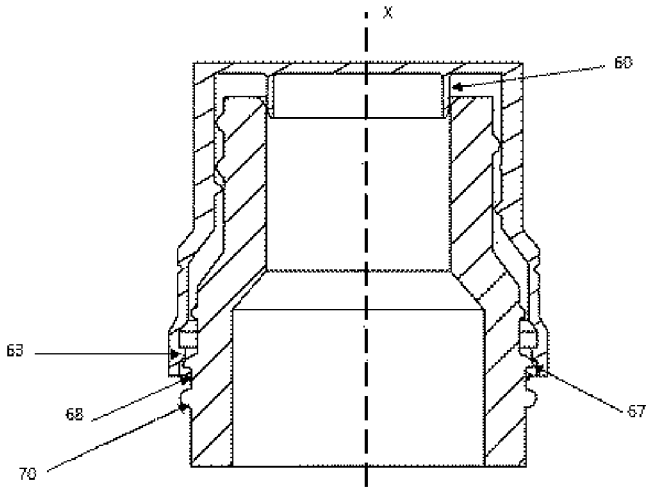
[Fig. 14]
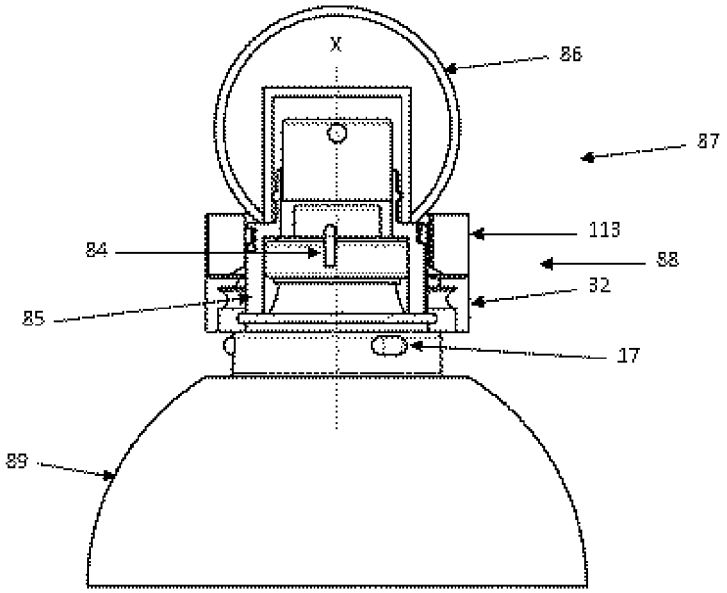

[Fig. 15]
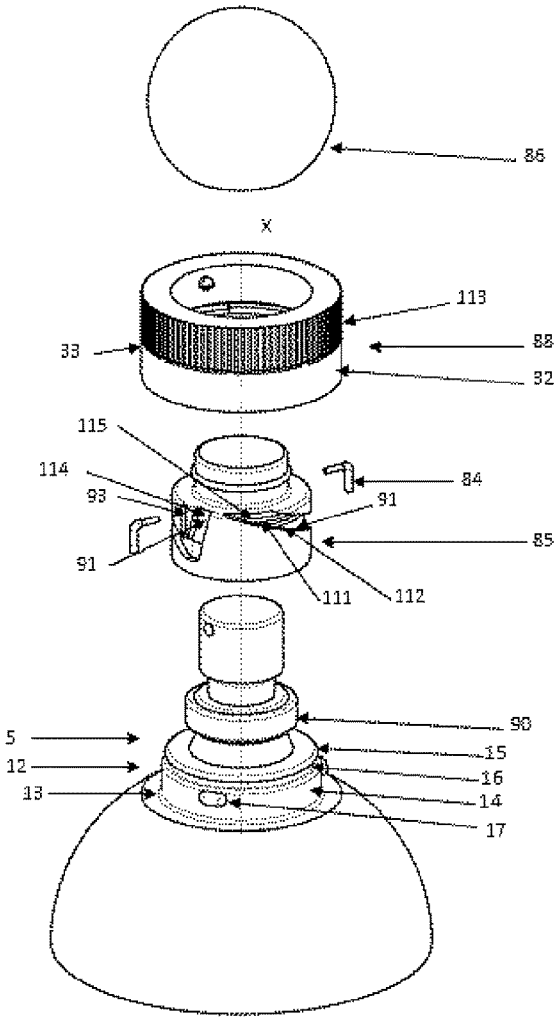
[Fig. 16]
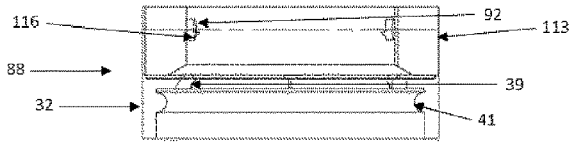
[Fig. 17]
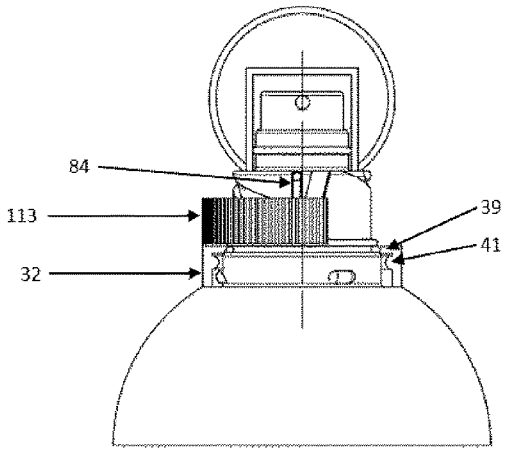

[Fig. 18]
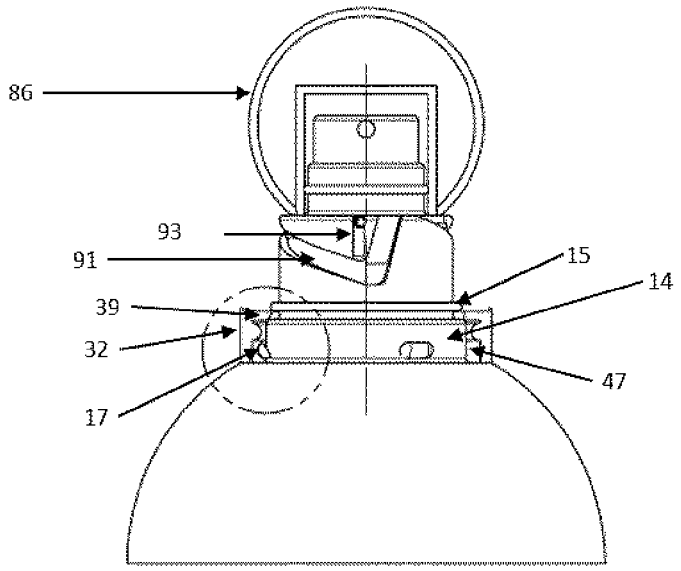
[Fig. 19]
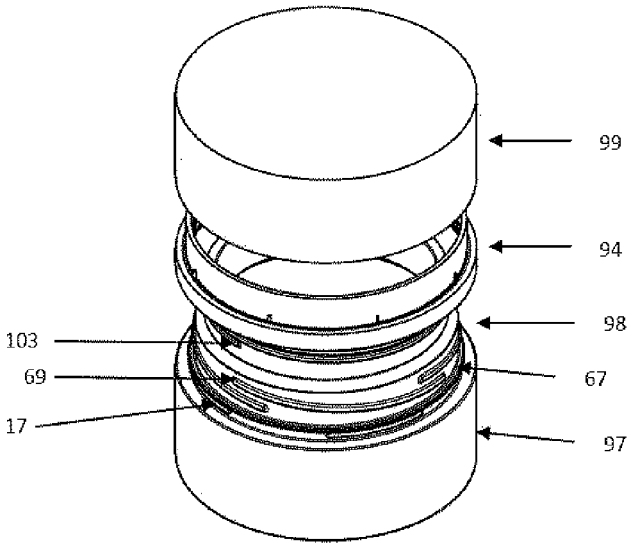
[Fig. 20]
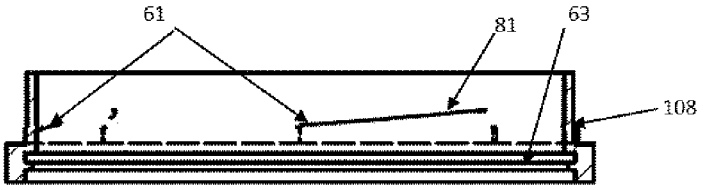
[Fig. 21]
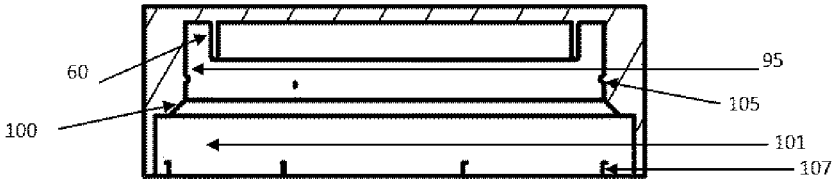

[Fig. 22]
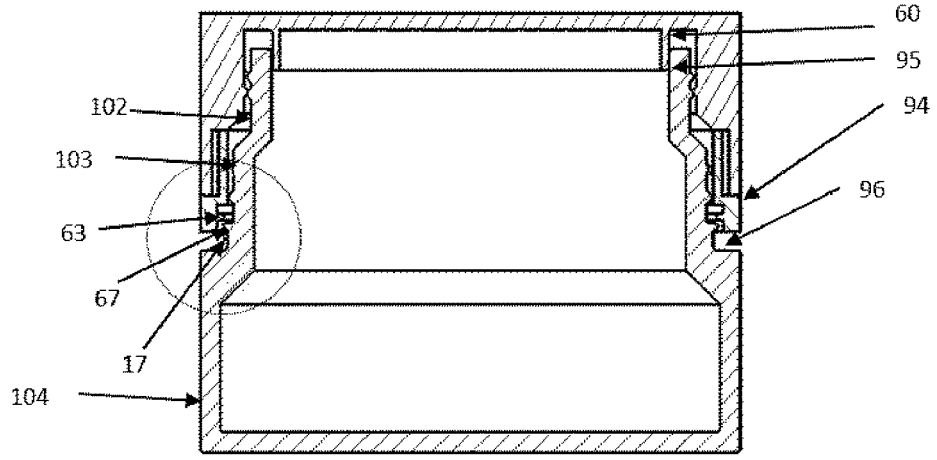
[Fig. 23]
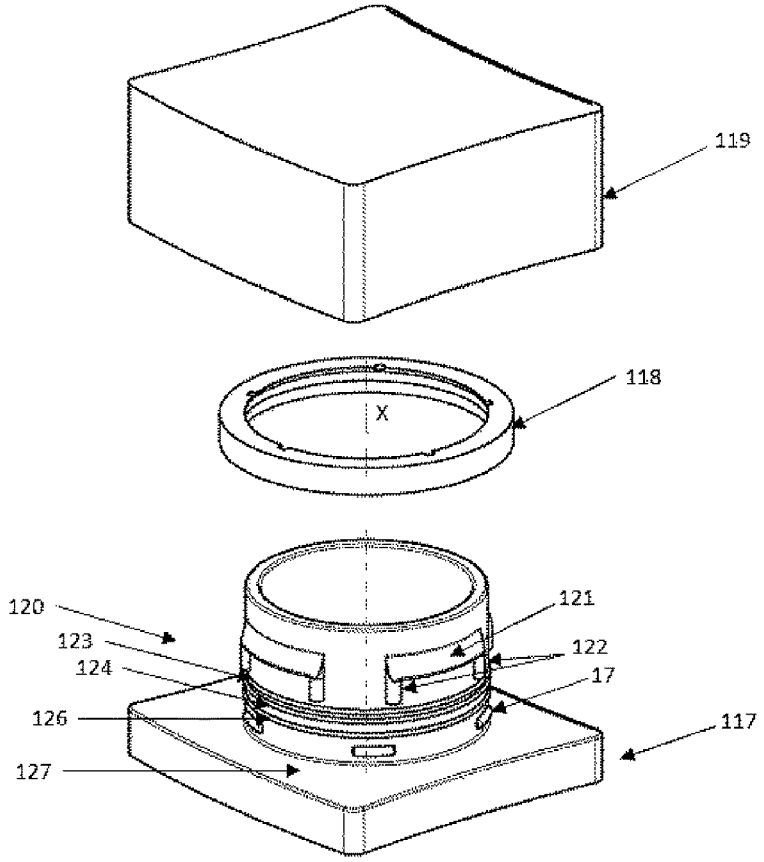
[Fig. 24]
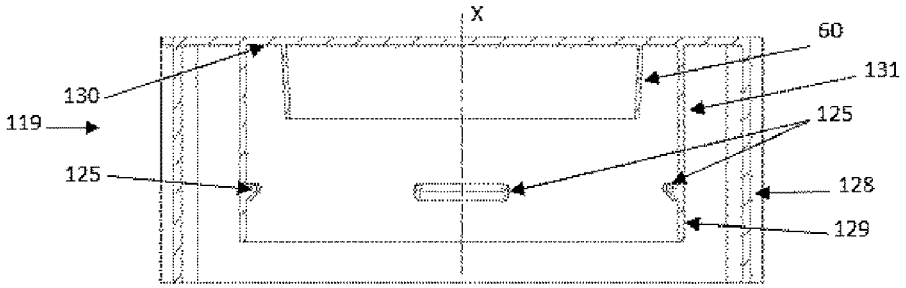

[Fig. 25]
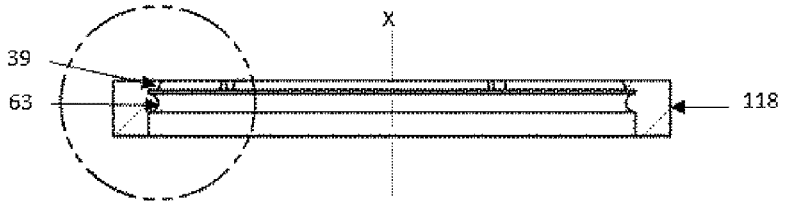
[Fig. 26]
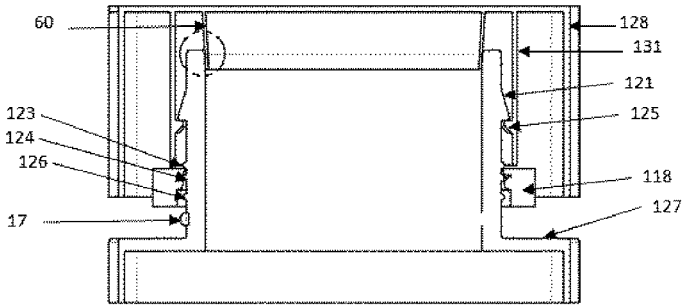
[Fig. 27]
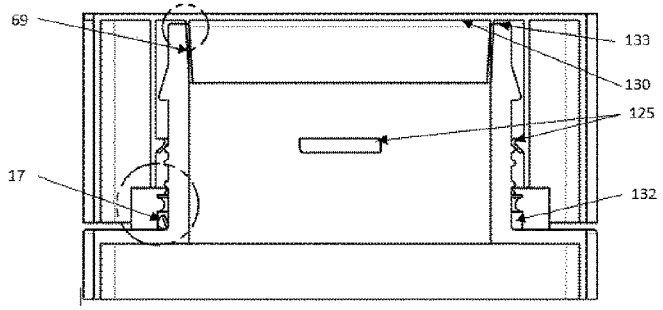
[Fig. 28]
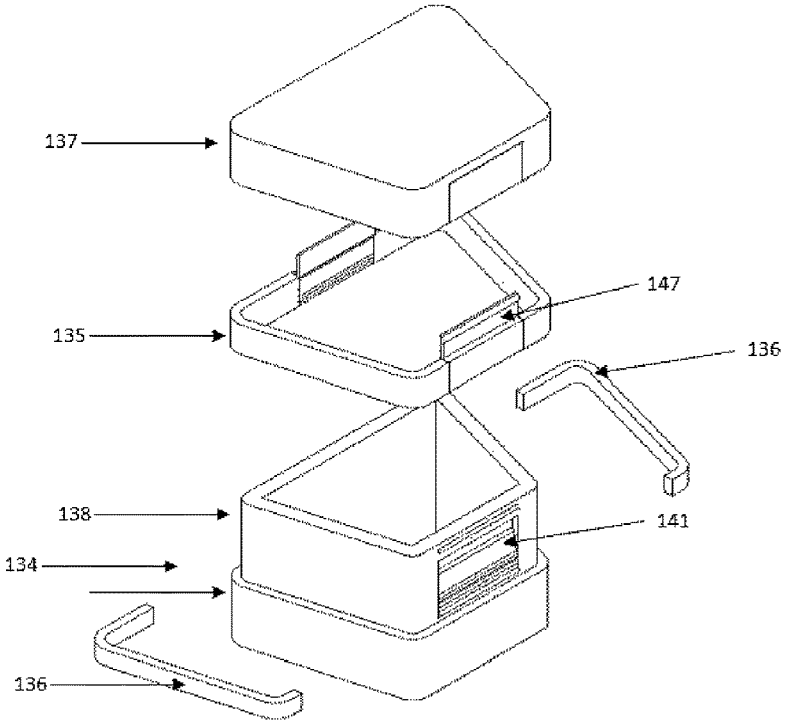

[Fig. 29]
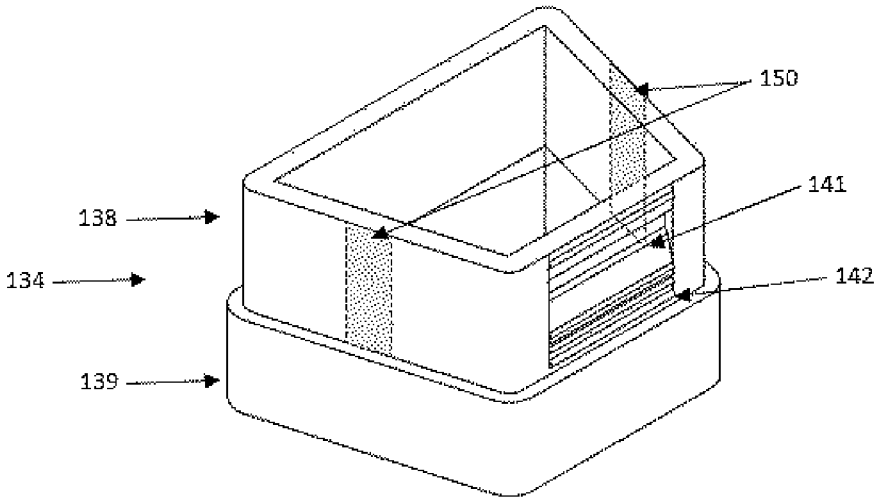
[Fig. 30]
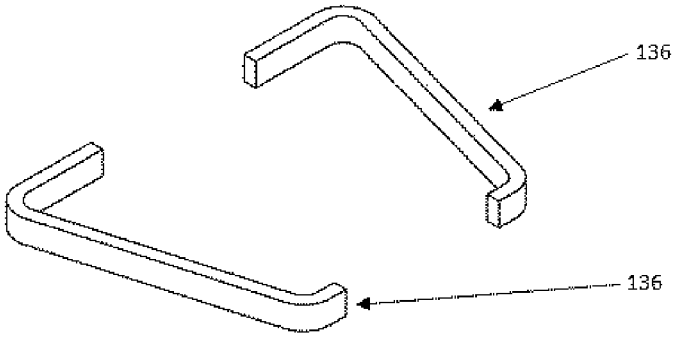
[Fig. 31]
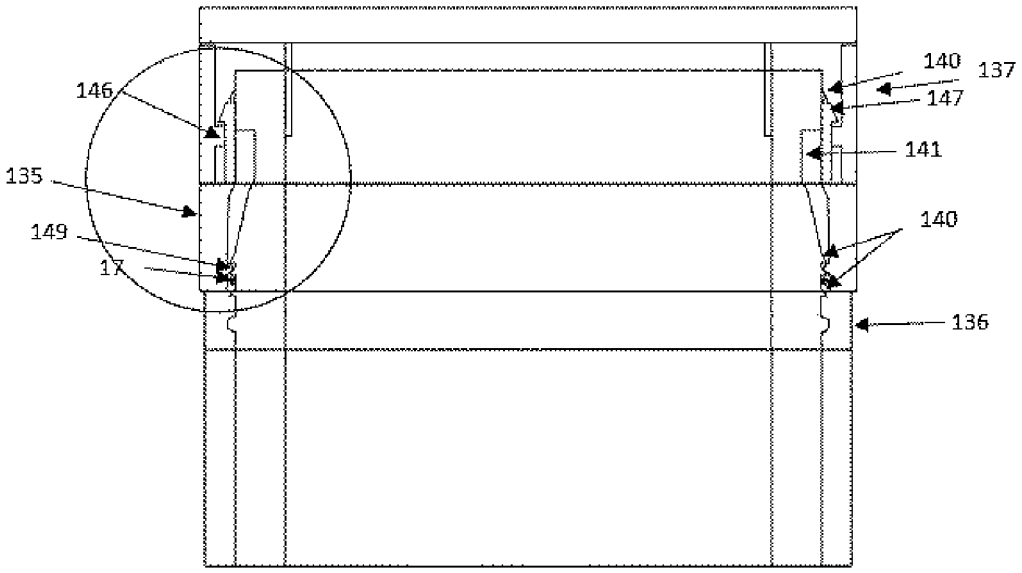

[Fig. 32]
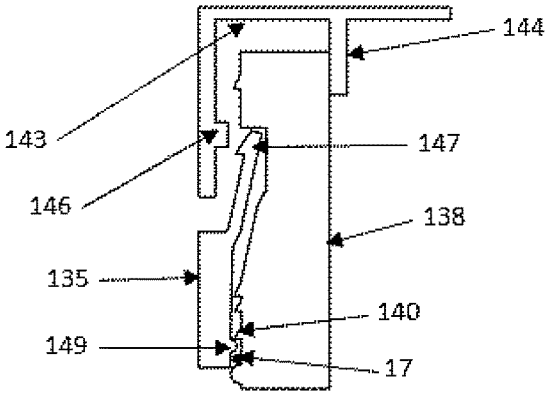
[Fig. 33]
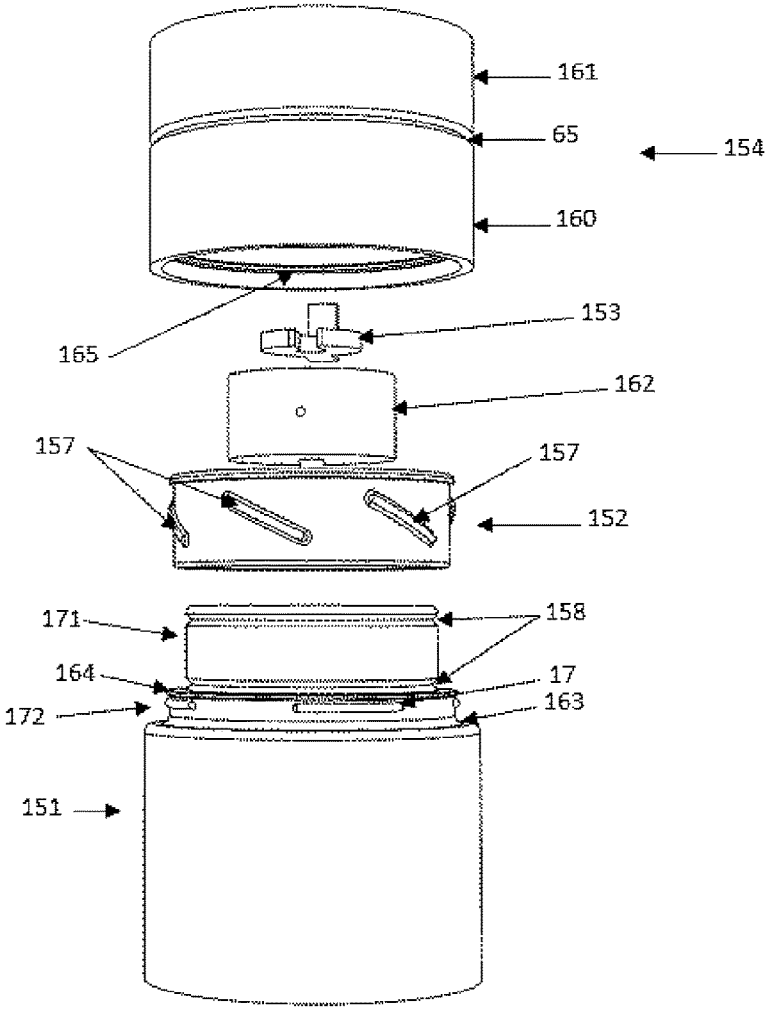
[Fig. 34]
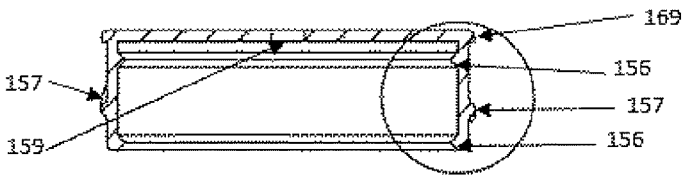

[Fig. 35]
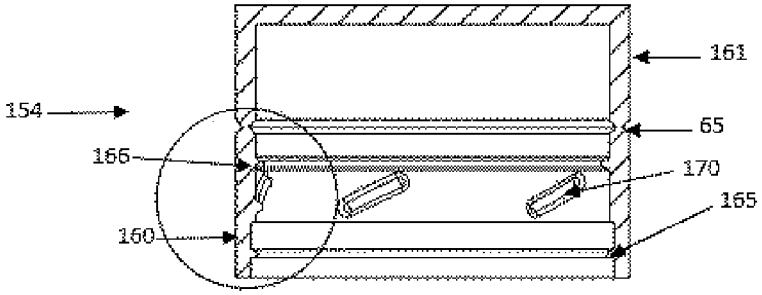
[Fig. 36]
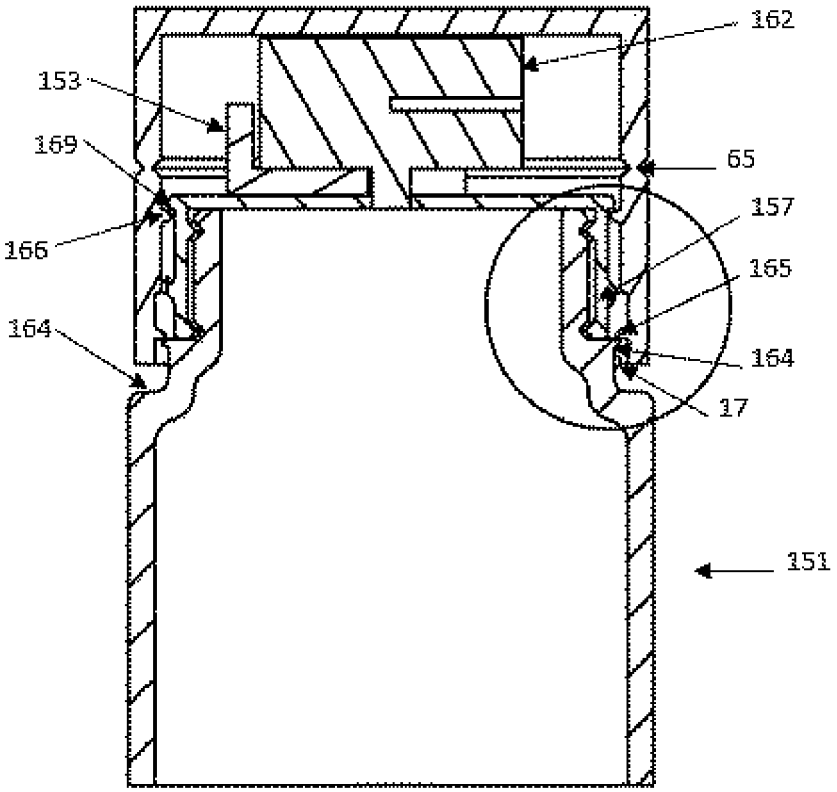

[Fig. 37]
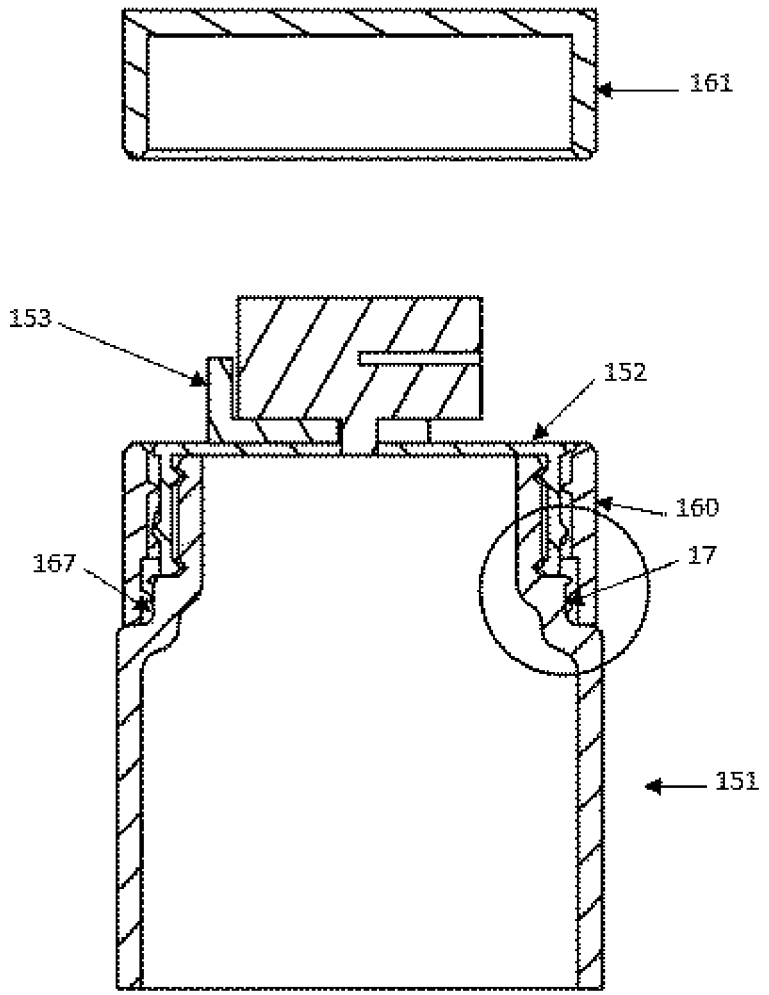

SECURITY CLOSURE SYSTEM AND DEVICES FOR CONTAINERS

DESCRIPTION OF THE INVENTION

The present invention relates to a tamper-proof closure system and closures for containers that can be applied in any type of container, preferably is applied, due to the rigidity properties, in containers made of rigid materials that can be selected from the group of ceramic, plastic and thermoplastic materials.

The tamper-proof closure system for containers of the present invention, on which the tamper-proof closures for containers, also described herein, are based, have their principle of operation in the evident rupture perceptible to the naked eye of one or more breakable elements that are part of the container. Said breakable elements are protruding portions that can be of varied geometries, which have the characteristic of being easily breakable. Preferably said breakable elements have geometric characteristics similar to the bottleneck thread of the container, with the difference that it is deliberately weakened in the manufacturing process, so that, by applying a force, previously calculated, during the process of opening this system, the rupture of said breakable elements occurs. It is worth mentioning that the amount of force necessary for the break is variable and depends on the requirements of each type of container depending on the requirements that the market and the regulations of each type of container indicates.

Conveniently the breakable elements are in the neck of the container, however, these elements can be found in the body of the container and fulfill the same function with the same operating mechanism.

The system allows or not, depending on the type of product and packaging, carry out an ocular or tactile inspection to verify the integrity of the breakable elements, evidencing to the user that the container has not been opened, in other words, the authenticity, so that if there is any fracture or signs of glue in the breakable elements of the system, the user can notice the possible violation or repair of a used and previously opened container.

Subsequent to the activation of the system, these fragments, when detached, may or may not be encapsulated or isolated for the greater security of the user.

The tamper-proof closure system for containers subject of the present invention can be found in three positions.

The first position, or pre-opening position, is that which results after the first closure, that is after the container has been filled by the manufacturer, where said closure is irreversible, unless the system is activated, and if desired, the closure is able to seal hermetically, which means that once the container is closed, coming out of the filling process, it is impossible to remove the closing system from the container without activating the system, making it obvious to the naked eye the first opening, mainly thanks to the breaking of the breakable elements.

The second position called activation, is the one in which the system has been used by the consumer at the time of starting the opening of the container for the first time, but has not yet completed the opening process, so there has not yet been access to the product inside the container, it is also characterized because it is the one in which the breakable element has already been fractured, and in the case simultaneously captured or encapsulated by the same system, and the violation of the closure of the container is evident to simple view for any consumer from this moment on.

The third position of the container closure system or post-opening position, results after separation of the lid and the ring or mechanical element in which the breakable elements will be encapsulated once they have been effectively fractured. As mentioned, the closure system is provided with a mechanism that allows it to be applicable for a wide variety of containers through a common or intuitive opening movement, which can be enunciated but not limited to turning the lid anti-clockwise, or applying a push and release action of the lid for containers that close with pressure, as will be exemplified throughout this document.

At the moment of breakage of the breakable elements, it is the purpose of the present tamper-proof closure system for containers, to prioritize the safety of the consumer who opens the container to access the product inside. Consequently, it is imperative to keep the element or breakable elements, once fractured, isolated to prevent them from causing contamination to the product or, wounds or accidents to the person opening the container.

To achieve the mentioned purpose in the previous paragraph, preferably the lid or closure system has a section that can be removable or independent in its lower portion, which completely surrounds a portion of the neck of the container and engages with the structure of the container during the vertical downward movement, at the same time in which the breakable elements are captured by encapsulating them between the cavity or space formed by the interior walls of the detachable or independent section of the lid and the outer walls of the container.

The breakable elements, when detached and immobilized from the original container, may or may not be immersed in any substance that also immobilizes them, said substances may be selected from the group of adhesives, resins, or gums.

Once the downward vertical displacement is completed and the breakable element has been fractured and captured as explained, a mechanism that facilitates a vertical upward displacement, which occurs either by turning the cover anticlockwise, or by other mechanisms such as removing the lid by pressure when separating vertically from the container. At the moment that this upward movement begins, the independent or detachable section of the lid is already fixed and/or hooked to the body of the container, so that the vertical movement upwards, the blocking of the detachable element and the weakening to this section of the lid, if applicable, together cause the irreversible detachment of this section of the lid, resulting in the third and last position of the closure system of security for containers called post-opening position.

Once the system has reached the third position or post-opening position, the lid of the container may or may not be placed and removed as many times as desired in order to preserve the contents of the container safe from contact with the environment, without imply complexities of use for the end user, but allowing to make evident that the container has been opened.

The present tamper-proof closure system for containers, optionally may have additional means to reinforce the evidence that the container has been opened for the first time. Said additional means may be chemical, electronic or physical and are activated as part of the use of the system. As chemical means, color or fluorescence systems embedded in the external part of the container that are visible to the naked eye or activated upon opening the container without releasing substances, also the external part of the bottle can be impregnated with some chemical substance difficult to remove and easily observable. The additional physical means to indicate that the container has been opened may consist of, but not limited to, generating a friction mark at the time of first opening of the container, so that they are visible to the consumer, and/or the disclosure of some visible code or signal.

The tamper-proof closure system for containers described above allows the design of different tamper-proof closures for containers, using screw closure and opening systems, snap-on systems, lever systems, and in general mechanical systems, which are examples of how the system can be applied and they are mentioned in an enunciative way, but they should not be understood as limitations to the tamper-proof closure system for containers.

FIELD OF THE INVENTION

This invention falls in the field of mechanics, more specifically describes a system and tamper-proof closure for containers of different geometries that allows the consumer to identify if the container has been previously opened by partial and controlled destruction of certain breakable elements, warning of possible reuse or re-filled of original containers.

State of Art

Now a days, counterfeiting goods represent enormous challenges for almost all industries since counterfeiting of products is a widespread practice that causes multi-million dollar losses. This patent represents a great social impact, due to the benefits it will have by avoiding the intake and consumption of harmful substances, encouraging the payment of taxes and shielding intellectual property, improving corporate image, promoting quality jobs, eradicating sources of financing for organized crime, strengthen a culture of legality, promoting investment, and with this all the intangible benefits that represent the eradication of a strong crime financing.

These practices always affect society, especially when these products come into direct contact with the body or are ingested by the consumer as in the case of food, beverages, cosmetics, perfumes and medicines, affecting health and sometimes life itself. Many systems and devices for closing containers, in addition to fulfilling their function of closing and opening have been designed in order to prevent the production of apocryphal copies of the products or to reuse the original containers with a content different from the original.

Most of the existing systems in the state of the art base their operation on blocking and/or destruction of some element of the lid itself and not of the container, facilitating the adulteration of said products by means of the repurchase for reuse of empty containers and/or the unauthorized replica of said covers at low cost.

Many, the designs of safety caps are designed for the alcoholic beverages industry due to their economic importance, many of them consist in the breaking of a ring that is inserted as part of the same lid and this ring is detached at the moment that the consumer opens for the first time the bottle in question, as for example the patent document "PTL: US20050011855A1" "Bottle cover inviolable" in which a lid attached to a ring that is detached by the force is inserted into the bottle applied at the time when the consumer opens the bottle and it becomes evident that the bottle has been opened for the first time.

There are also other more complex mechanisms such as the case of the patent application "PTL: EP2769927 A1" "inviolable closure system for bottles" in which a method is proposed so that after the opening of the bottle the lid is unable to return to its original position counting on a ring that has the function of making this as obvious as possible for the consumer. In this case, it will be more complicated to obtain the replica of this lid to fill the bottle, however, there are organizations capable of replicating these kind of caps in an unauthorized way since they are made of plastic materials.

The patent application "PTL: EP2769927 A1" "Fake proof system for bottles" mentioned in the previous paragraph, documents such as "PTL: EP1981774 B1" "Closing device for bottles, in particular for bottles alcohol or spirits" base it's operation on the same principle to identify if the bottle has been opened previously, this type of caps present the same vulnerability unlike the present invention that combines an element that is part of the container and a lid non-easy to replicate which makes its unauthorized reproduction much more difficult and expensive.

Other designs that contemplate the destruction of some element part of the container and act in conjunction with the closure system, are to mention the closest to this invention, the US patent application "PTL: US20120091091A1" "Stamp for a system closure for tamper-proof bottles" which contemplates the destruction of an element that protrudes from the bottle and is destroyed at the time the bottle is opened for the first time. However, said element is easily replaceable because it is joined by some adhesive and is not part of the original container facilitating its falsification, unlike the present invention whose breakable element is part of the container from its manufacture.

The US patent application "PTL: U.S. Pat. No. 3,165,220A" "Tamper-proof container" shows a tamper-proof system consisting of the irreversible cutting of a button at the time the container is opened. However, said system presents a high vulnerability because the lid can be removed easily without cutting the button, due to the design of the lid and the container, and this way violate the closure system, exposing the product to be exchanged or adulterated, and making it impossible to differentiate between a container with the breached closure and an original one, unlike the present invention which, thanks to its design, prevents the lid from being removed without damaging the container or causing the fracture of the container, the breakable elements, in addition to encapsulating the captured fragments and preventing the consumer from coming into contact with them.

Similarly, the patent document "PTL: EP0722890B1" "Indicator device for falsifications for a container and process for its manufacture" discloses a closure system in which small protrusions are projected on the neck of the bottle and are designed so that at the moment of opening the bottle by means of a force, these fragments are cut, evidencing that the bottle has been opened. However, this system is relatively simple to violate, due to its particular mechanical design, which is simple to hack, that is, it can be opened without activating the system, and in this way adulterate or exchange the content and close it again doing. Besides having the limitation that it cannot be applied in systems other than cork bottles, the present invention makes it possible to show that the bottle has been opened by fracturing a fragment of the container and with a complex system non-easy replicating, which raises the cost of counterfeiting. Furthermore, the system of the present invention is not limited to being used in a particular kind of container, so it can be applied in multiple containers and commercial purposes.

SUMMARY OF THE INVENTION

The present invention relates to a tamper-proof closure system and closures for containers that can be applied in any type of container, preferably is applied, due to the rigidity properties, in containers made of rigid materials that can be selected from the group of ceramic, plastic and thermoplastic materials.

The tamper-proof closure system for containers of the present invention, on which the tamper-proof closures for containers, also described herein, are based, have their principle of operation in the visible breaking with the naked eye of one or more breakable elements that are part of the container. Said breakable elements are protruding portions that can be of varied geometries.

The system allows or not, depending on the type of product and packaging, carrying out an ocular or tactile inspection to verify the integrity of the breakable elements, evidencing to the user that the container has not been opened, in other words, the authenticity, so that, if there is any fracture or signs of glue in the breakable elements of the system, the user can recognize the possible violation or repair of a used and previously opened container. Subsequent to the activation of the system, these fragments, when detached, may or may not be encapsulated, isolated or contained, for greater user safety.

The tamper-proof closure system for containers subject of the present invention can be found in three positions; the first position or pre-opening position is the one that results after the first closure, the second so-called activation position, is the one in which the system has been put into action by the consumer at the moment of beginning the opening of the container for the first time, and the third position of the closure system of containers or post-opening position that results after the separation of the lid and the ring or mechanical element in which the breakable elements will be encapsulated once they have been effectively fractured. The tamper-proof closure system for containers described above allows the design of different tamper-proof closures for containers, using screw closure and opening systems, snap-on systems, lever systems, and in general mechanical systems, which are examples of how the system can be applied and they are mentioned in an enunciative way, but they should not be understood as limitations to the tamper-proof closure system for containers.

Technical Problem to be Solved

Most of the existing systems in the state of the art base their operation on blocking and/or destruction of some element of the lid itself and not of the container, facilitating the adulteration of said products by means of the repurchase for reuse of empty containers and/or the unauthorized replica of said closures at low cost.

Technical Solution

The tamper-proof closure system for containers of the present invention, on which the tamper-proof closures for containers, also described herein, are based on the principle of operation including the evident rupture, at first glance, of one or several breakable elements that are part of the container.

Advantageous Effects

The tamper evident closure system of the present invention and the examples that derive therefrom have their operating principle in the evident breaking with the naked eye of one or more breakable elements that form part of the container. Said breakable elements are protruding portions that can be of varied geometries, which comply with the characteristic of being breakable.

BRIEF DESCRIPTION OF THE DRAWINGS

FIG. 1. It shows an exploded view of the closure of example 1 of a tamper-proof closure for containers in their type for alcoholic or non-alcoholic drinks, in which the bottle 2, the inner monolithic piece 3 and the outer monolithic piece 4 are observed, as well as the elements that are defined in each one.

FIG. 2. It shows a side view of the bottle 2 of the closure of example 1 where the structure of the neck 5 in which the breakable elements 17, the thread 10 and the other elements that intervene in the operation of the closure are shown in detail.

FIG. 3. It shows a perspective view of the inner monolithic part 3 of the closure of example 1.

FIG. 4. It shows a perspective view with axial section of the inner monolithic part 3 of the closure of example 1.

FIG. 5. It shows a side view of the inner monolithic part 3 of the closure of example 1 in which the radial rotation brakes 24 and their spatial arrangement are clearly visible.

FIG. 6. It shows a lateral view of the axial section of the monolithic external part 4 of the closure of example 1, which allows to appreciate the weakened breakable segment 32, the lid segment 31 and the elements that make them up.

FIG. 7. It shows a view of the bottle neck 5 of the bottle 2, the inner monolithic part 3 and the outer monolithic part 4 of the closure of example 1, coupled in their pre-opening position.

FIG. 8. It is a side view of the closure of example 1, with axial cut in which the coupling of the closure is appreciated once it is in the post-opening position.

FIG. 9. It is an exploded view in perspective of the closure of the best way to perform the invention.

FIG. 10. It is an exploded lateral view in transparency of the closure of the best way to realize the invention.

FIG. 11. It is an exploded side view with the bottle neck and breakable ring weakened in transparent material of the closure in the best way to carry out the invention.

FIG. 12. It shows a side view of the section of the neck interacting with the breakable ring weakened in it's longitudinal section of the closure in the best way to realize the invention.

FIG. 13. It shows a front view of the closure in the best way to carry out the invention with a longitudinal section in its pre-opening position.

FIG. 14. It is a side view with longitudinal section of the tamper-proof closure of example 3 in its pre-opening position.

FIG. 15. It shows an exploded view of the elements of the tamper-proof closure of example 3.

FIG. 16. It is a lateral list with longitudinal section of the disposable ring of the tamper-proof closure of example 3.

FIG. 17. It is a side view of the tamper-proof closure of example 3 in its activation position.

FIG. 18. It is a front view of the tamper-proof closure of example 3 in its post-opening position.

FIG. 19. It is an exploded view in perspective of the elements of the tamper-proof closure of example 2.

FIG. 20. It is a side view with longitudinal section of the independent ring of the closure of Example 2.

FIG. 21. It is a side view with longitudinal section of the lid of the closure of Example 2.

FIG. 22. It is a side view with longitudinal section of the tamper-proof closure of example 2 in its pre-opening position.

FIG. 23. It shows an exploded view of the tamper-proof closure for containers with snap closure caps of example 4.

FIG. 24. It shows a side view with a longitudinal section of the lid of the tamper-proof closure for containers with snap-on caps of example 4.

FIG. 25. It is a side view with a longitudinal section of the activation ring of the tamper-proof closure for containers with snap-on caps of example 4.

FIG. 26. It is a front view with a longitudinal section of the tamper-proof closure for containers with snap-on closure caps of example 4 in its pre-opening position.

FIG. 27. It is a front view with a longitudinal section of the tamper-proof closure for containers with snap-on closure caps of example 4 in its activation position.

FIG. 28. It shows an exploded view of the tamper-proof closure for containers of Example 5 and the elements that comprise it.

FIG. 29. It shows a perspective view of the container of the tamper-proof closure for containers of example 5.

FIG. 30. It is a panoramic view of the provisional structures of the tamper-proof closure of example 5.

FIG. 31. It shows a side view with longitudinal section of the tamper-proof closure of example 5 in its pre-opening position.

FIG. 32. It is a side view with a longitudinal section in detail of the safety closure device of example 5 in its post-opening position.

FIG. 33. It is an exploded view of the tamper-proof closure of Example 6.

FIG. 34. It shows a front view with longitudinal section of the lock of the tamper-proof closure of Example 6.

FIG. 35. It shows a front view with longitudinal section of the single monolithic lid of the tamper-proof closure of Example 6.

FIG. 36. It is a side view with longitudinal section of the tamper-proof closure of Example 6 in its pre-opening position.

FIG. 37. It is a side view with a longitudinal section of the tamper-proof closure of Example 6 in the post-opening position.

MODES OF CARRYING OUT THE INVENTION

The tamper-proof closure system for containers described above allows the design of different tamper-proof closures for containers, using screw closure and opening systems, snap-on systems, lever systems, and in general mechanical systems, which are examples of how the system can be applied and they are mentioned in an enunciative way, but they should not be understood as limitations to the tamper-proof closure system for containers.

Example 1

Tamper-Proof Closure for Beverage Bottles.

The example 1 illustrated in [FIGS. 1-8] presents a tamper-proof closure 1 for a beverage bottle 2, for example, a bottle of spirits or alcoholic beverages, which is comprised of two monolithic pieces 3 and 4 and a bottle neck 5 specially designed to interact with the monolithic pieces 3 and 4.

The bottle 2 is made of any plastic or ceramic vitreous material, being in this case preferentially made of glass, as shown in [FIG. 2] it extends along an X axis and comprises a neck 5 having a wall external side 6 and provided with an opening at one end 7 linked with an annular edge 8. The neck 5 comprises a screw portion 9, next to the opening 7 and provided with an external thread 10, and an anchoring mechanism 11 projecting as a relief on the external side wall along the X-axis.

The neck 5 is also provided with a flange defined in particular by a collar 12, which is defined as an external radially continuous annular collar, positioned on the external side wall 6. The mentioned collar 12 in its longitudinal portion, consists of three main sections defined by decreasing radial lengths, with the final support section 13, the furthest from the opening 7, the largest radius, followed by the intermediate section 14 which is radially smaller than section 13 and finally the initial support section 15 less than sections 13 and 14. Between the sections 14 and 15 is located the securing section 16 which is defined as being a concavity extending radially on the body of the collar.

On the surface of the outer wall corresponding to the intermediate section 14 of the collar 12 are arranged a plurality of breakable elements 17 which are reliefs similar to portions of the threads 10 which are in the screw portion 9 with the difference that the breakable elements are susceptible to fracture by applying an axial force thanks to a design that leads the desired weakness, [FIG. 2].

The inner monolithic part 3 comprises a monolithic hollow part preferably of some plastic material, substantially tubular and which extends along the axis X between an open axial end 18 and a first closed axial end 19, a second closed axial end 49 and has a substantially cylindrical side wall 20 about the X-axis. The inner monolithic part 3 is further conformed of an external thread 21, an internal thread 22, a latching flange 23, a plurality of at least two radial rotating brakes 24, an assembly guide 34 and a closed axial end 25 and an upper surface 26, as can be seen in [FIGS. 3, 4 and 5].

The outer monolithic part 4 illustrated in [FIGS. 4, 5 and 6] comprises a monolithic hollow part preferably of some plastic material, substantially tubular and which extends along the X axis between an open axial end 27 and an axial end closed 28 and has a lateral wall 29 substantially cylindrical and smooth sidewall around the X-axis. Referring to [FIG. 1], the piece 4 comprises an upper lid segment 31, and a weakened breakable segment 32 at the lower end of the piece, preferably made of some transparent material, which is connected and joined to the upper segment of cover 31 by a plurality of circumferential junctions 33 perpendicular to the X axis.

At the upper end of lid 31 of the outer monolithic part 4 there is an assembly guide 35 defined by two projections parallel to the X axis with a spacing from each other slightly greater than the thickness of the assembly guide 34, an irreversible latching mechanism 36 consisting of a plurality of elements projecting from a rectangular base of the inner wall of the outer monolithic part 4, which at their free end have a wedge-shaped termination, in which an inclined plane is defined 37 and a flat blocking surface 43.

In the same way, on the internal side wall of the upper lid portion, the part 4 has an inverted internal thread 30, which when inverted generates a downward movement in the X axis when performing a counter-clockwise, and a radial tooth 38 is defined by a projected circumferentially continuous ring.

In the inner wall of the weakened breakable segment 32, a plurality of engaging elements 39 are provided at the upper end with a wedge-shaped end 51, similar to the irreversible engaging element 36 that allows the downward displacement on the X-axis but not the ascending by the interaction of the flat surface 40 and the securing section 16, which prevents said ascending axial movement. Also immediately below the engaging elements 39, is an encapsulator 41, defined in particular by a radially continuous internal annular collar.

Once the beverage bottle 2 has been filled by the manufacturer, the bottle is hermetically sealed by the threaded coupling of the external thread 10 of the bottle and the internal thread 22 of the inner monolithic part 3 by a clockwise twist like most conventional caps until the annular rim 8 is in contact with the first closed axial end 19 between which a membrane that lead tightness can also be included, making this process can be integrated into lines of production with conventional bottle closure systems, either manually or automated.

Subsequently, as shown in FIG. 7, the monolithic outer part 4 is coupled to the internal monolithic part 3 with a push movement, with a downward axial movement, so that the assembly guide 34 is axially aligned so that it can be coupled between the two protuberances of the assembly guide 35 once, by applying force in downward direction to the monolithic part 4, the irreversible engaging elements 36 have descended below the engaging flange 23 of the inner monolithic part, this results in the irreversible engagement of the monolithic pieces.

The irreversible engagement of the monolithic parts is achieved by the interaction of the inclined surface 42 of the flange 23 and the inclined plane 37, which as a result of their inclination allow, by applying stress, the side wall of the external monolithic part 4 is deformed until the hooking occurs. Engagement occurs when the surfaces 42 and 37 cease to be in contact and cause the area of the flat locking surface 43 and the flat surface 44 of the engagement flange 23 to be in direct contact.

Once the foregoing events have occurred, it is considered that the tamper-proof closure for containers is in the pre-opening position, in this position the assembly guides 34 and 35 are coupled and fulfill the function of preventing piece 4 leaves it's position before the end user opens the bottle for the first time, in this pre-opening position, the manufacturer offers the bottle to the final consumer, [FIG. 7]. It is a purpose of the present invention that the breakable elements 17 are easily visible to any person so that he can easily determine if the bottle has been opened for the first time, in the pre-opening position the closure is designed to make evident the integrity of the breakable elements by ocular inspection by any person.

Conveniently in the pre-opening position, there must be a plurality of radial rotation brakes 24, preferably 2, same elements that must coincide axially in the pre-opening position with the radial tooth 38. At the same time it should be noted that the anchoring stops 11 are aligned axially and adjacent to the right side of the radial turning brakes 24 when the closure is in the pre-opening position.

At the moment when the radial rotation brakes 24 and the radial tooth 38 are interacting in the pre-opening position, the radial rotating brakes 24 undergo an elastic deformation towards the center of the bottle generating an axial interference between said brakes radial turn 24 and the anchoring stops 11. This interaction results in the inner monolithic part 3 not being able to rotate counter-clockwise, in which direction the opening of the bottle is carried out.

Illustratively in [FIG. 7] the radial tooth 38 coincides axially with the two radial rotation brakes 34 positioned at 180 degrees which in turn are axially adjacent to the left of the anchoring stops 11, and in the position of pre-opening the brakes are activated by an elastic deformation of the same. The breakable elements 17 are in view.

At the moment that a person wants to have access to the contents of the bottle, he must open the bottle in a normal way applying a counter-clockwise rotation as it would with any bottle. However, in the case of the present closure, the assembly guides 34 and 35 will rupture. The first portion of the external thread 21 has no inclination, however, after this flat area 50 the external thread 21 has a negative inclination which induces a descent with the anti-clockwise rotation.

Once the downward axial displacement reaches the point at which the encapsulator 41 interacts with the breakable elements, the interaction of the flat surface 40 with the securing section 16, which requires an elastic deformation of the elements, also occurs almost simultaneously 39 to enter the securing section 16.

As a result of the properties of the plastic and the geometry of the latching elements once a radial coincidence occurs between the section 16 and the elements 39, the potential energy resulting from the elastic deformation results in an instantaneous acceleration sufficient to fracture the breakable elements at the same time that the resulting fragments are trapped in the insulation space 47 defined by the upper wall 45 of the final support section 13, the side wall 46 of the intermediate section 14, the surface of the lower portion of the encapsulator 41 and the inner wall 52 of the weakened breakable segment 32 in its lower portion.

Once the breakable elements 17 have been fractured and captured in the insulation space 47, the outer thread 21 stops interacting with the internal thread 30, likewise the radial rotation brakes 24 are released since the force that caused its elastic deformation is no longer present and the inner monolithic part 3 is free to rotate. The counterclockwise rotation of the piece 3 generates an upward displacement on the X axis of the part 3 coupled and irreversibly engaged with the piece 4 resulting in the final cover 48, this displacement will generate a tension on the weakened joints 33 causing the rupture of said joints and causing an evident and irreversible separation between the weakened breakable segment 32 and the lid segment 31, as shown in [FIG. 8].

Once this rupture has occurred, the final lid 48 is considered to be in its post-opening position, in this position the lid can be used by the client to open and close the bottle as many times as necessary in a conventional manner and it will be evident to anyone that that bottle has been opened because through the weakened breakable segment 32 (preferably manufactured from a transparent material) the rupture of the breakable elements 17 that are captured in the insulation space 47 are visible. It is clear that given the nature of the operation of this closure, the learning curve for consumers or end customers is almost zero.

Example 2

Tamper-Proof Closure for Cosmetic Containers with Independent Ring.

In [FIG. 19] the closure of example 2 with its exploded elements is illustrated, said elements being a container 97, an independent ring 91 and a lid 99. In [FIG. 21] the lid 99 can be seen in greater detail, which comprises a substantially tubular monolithic hollow part between an open axial end 56 and a closed axial end 57. The lid 99, made of any rigid material, has a substantially cylindrical wall around the X-axis with an inner diameter defined by the walls 101 and 95, where the wall 95 is that which is in contact with the closed axial end 57 and in which projects perpendicularly to the axis X a central sealing ring 60 which is a hollow cylindrical body projecting from the face 80 and is coaxial with the inner wall 95, the central sealing ring 60 is accommodated in its position of post-opening and pre-opening at the open end of the container 97 so as to promote a hermetic seal without the need for the face 80 to be pressed against the edge of the container 97.

At the closed axial end 57 a central sealing ring 60 is projected, and is accommodated in its post-opening and pre-opening position at the open axial end of the container 97 so as to promote a hermetic seal without the need for the surface of the closed axial end 57 to be pressed against the edge of the open axial end of the container to generate a seal. The outer wall 100 of the lid 99 can be smooth or have some type of texture, for example, corrugated, in order to facilitate the grip by the user.

In [FIGS. 19 and 22] it can be seen the container 97, which has its design with three different diameters so that it can be said that the container has three different outer walls, the wall 102, 103 and 104, each one of them corresponding to the different diameters where the wall 102 is the wall of the upper portion and smaller surface, the 103 larger than the 102 but smaller than the wall 104, the latter length being the one corresponding to the lower portion of the container in which the product is housed. The wall 102 located in the upper portion of the container, in which the open axial end is located has a thread 105, in the external side wall 103 are found; a complementary locking thread 69, an initial support ridge 67 and the breakable element(s) 17. Between the outer side wall 103 and 104 a final support surface is defined, which is a surface perpendicular to the X-axis and which results from the abrupt increase in diameter between the said external side walls.

Finally, the external side wall 104 is a cylindrical wall around the X-axis in which art designs and information about the product can be found, without this being part of the security system.

The independent ring 94 comprises a cylindrical hollow part of internal diameter equal to or slightly larger than the outer side wall 103. The outer side wall of the independent ring 94 should be in its lower part a diameter greater than the inner diameter of the base of the lid 99, and in its upper portion smaller than the diameter of the inner wall of the lid 99. Said dimensions have the purpose of generating an axial coupling of the cover with the independent ring so that the movement of the lid 99 undergoes in the downward direction is transferred to the independent ring and an upward movement of the lid 99 does not generate any momentum transfer of the cover 99.

Once the manufacturer has filled the container 97 with the product to be packaged, the independent ring 94 should be placed so that the end in which the fracturing ring is located is oriented downward with respect to the X-axis, in other words, the independent ring 94 should be placed in such a way that its thickest end is oriented downwards. This axial coupling must occur until the locking thread 61 of the independent ring 94 and the complementary locking thread of the container 97 meet and the generated interference does not allow axial coupling.

Once the separate ring 94 is positioned as described above, to place the lid 99 and carry a threaded engagement of the cap 99 to the container 97 through the cover thread 106 and container thread 105, said coupling should be performed making a turn, either automated or manual means, clockwise as is normally closed most conventional containers. Must be rotated clockwise until the force is enough to push the separate ring 94 in a downward direction and a deformation of the locking thread 61, which is conveniently made of an elastic material is produced, which at the time still supplying mechanical stress derived from the torque of the threaded coupling between the cap 99 and container 97, an elastic deformation in the thread 61 allowing it to pass over the thread 69, made of glassy material without producing any rupture or permanent deformation. Once the threads 81 which form the thread 61 have passed over the threads of the thread 69 produces a "click" sound, which indicates that the cover is in position pre-opening, such as it is shown in [FIG. 22].

In the pre-opening position, as illustrated in [FIG. 22], the interference that is generated between the radial brakes 107 and the complementary radial brakes 108 makes impossible the upward movement of the lid 99 without activating the security locking system of the present example. On the other hand, the downward movement of the lid 99 and the independent ring 94 that is generated when turning clockwise is automatically blocked upon completion of the events described above by interference of the fracture ring 63 and the initial support ridge 67 of the closure as illustrated in [FIG. 22].

The final consumer acquires the product with the tamper-proof closure in the pre-opening position, in which he can verify that the container has not been opened from the moment of its closure in the manufacturer's factory, this verification is carried out performed by sensory means, being it a visual inspection or a tactile inspection. The visual inspection consists in verifying the integrity of the breakable elements 17 with the naked eye and the tactile verification consists in the palpation of the breakable elements 17 that are accessible to the touch.

At the moment of wishing to have access to the contents of the container, the customer must carry out an anti-clockwise rotation, as in most commercial closures, which will generate, through the threaded coupling of the locking thread 61 and the thread of complementary block 69, a downward movement that when supplied with a sufficient amount of mechanical energy will generate the elastic deformation of the fracture ring 63 that will pass over the initial support ridge 67. Conveniently, when the elastic deformation of the fracture ring 63 occurs and passes over the initial support ridge 67, an instantaneous acceleration of the lid 99 and the independent ring 94 is generated, which will cause an impact on the breakable elements with sufficient energy and speed to fracture the breakable elements 17 and to capture them immediately, preventing them from coming into contact with the outside.

The capture of the breakable elements 17 subsequent to its break in the insulation space 109, defined by the lower face of the fracture ring 63, the inner wall portion of the independent ring 91 below the fracture ring 63, the lower face of the initial support ridge 67, the upper face of the final support ridge 96 and the neck portion between the support 67 and ridge 96. After the breaking and capture of the breakable elements 17 it is considered that the closure is in the activation position.

Once the closure is in the activation position the independent ring 94 will be irreversibly coupled and hooked with the container 97, keeping the breakable elements 17 captured in the isolation space 109 once they are separated from the container 97. At this point the lid 99 can be raised axially so that the radial brakes 107 of the lid 99 and the radial brakes 107 of the independent ring 94 cease to have interference and the lid 99 can be rotated counterclockwise to open the container and have access to the product, resulting in the post-opening position. Conveniently the lid 99 can open and close the container as many times as the consumer requires to access the product when desired.

Example 3

Tamper-Proof Closure for Sprayable Liquid Containers with Disposable Ring.

The tamper-proof closure for sprayable liquids containers with disposable ring of example 3, [FIGS. 14-18], like the foregoing examples, bases its operation on the tamper-proof closure system for containers of the present invention, and it can be seen in [FIG. 15], where it can be seen that it consists of a bottle 89, a neck 5, a shirt 85, a pair of keys 84 and a cap 86.

The bottle 89 is made of any plastic or ceramic vitreous material, being in this case preferably made of glass, as shown in [FIG. 15] it extends along an X axis and comprises a neck 5 having a wall external side and is provided with an opening at the upper end, which is an atomizer 83 which in turn is attached to the bottle by a metal lockseam 90. The neck 5 comprises a metal lockseam 90, a flange defined in particular by a collar 12, which is defined as being a radially continuous external annular collar positioned on the external side wall, which in turn in its longitudinal portion is formed of three main sections defined by decreasing radial lengths, the final support section 13 is the one furthest from the lockseam 90 and the one with the largest radius, followed by the intermediate section 14 which is smaller radially than the section 13 and finally the section of initial support 15 less than sections 13 and 14. Between the sections 14 and 15, securing section 16 is defined to be a concavity extending radially on the body of the collar is located.

On the surface of the external wall corresponding to the intermediate section 14 of the collar 12 are arranged a plurality of breakable elements 17 which are reliefs projecting perpendicularly to the axis X and are susceptible to breaking through the application of an axial force thanks to a design that generates the desired weakness.

The sleeve 85 is defined by a substantially cylindrical and hollow body, with an internal diameter that allows its axial coupling with the metal lockseam 90. In its outer wall in its lower portion has two channels 91, arranged at a radial distance of 180°, in the form of a square where at one of its ends has a negative inclination that extends to reach a point where the channel changes its inclination and goes from being negative sloped to rising steeply at an angle slightly less than 90° until it reaches the edge end of the lower portion of the shirt, conveniently the turning points where the flange changes from negative to positive slope, the profile it is rounded, as can be seen in [FIG. 15]. Inside the gutters 91, in the initial portion of the negative slope, two ridges, a first flange 111 and a second flange 112 project radially and perpendicularly to the axis X.

As shown in [FIG. 15], the sleeve 85 has two cavities arranged at 180° between each, which are designed to house the pins 84.

The activation ring 88 is defined as being a hollow cylindrical body constructed of some rigid material, for example; from the group of plastics, thermoplastics or metals. Said activation ring 88 is formed of two axial sections, an upper portion 113 and a weakened breakable segment 32 joined by means of weak joints 33. In its inner section the upper portion 113 of the activation ring 88 has two cylindrical projections or guide buttons 92 with a locking tooth 114 at its free end. In the weakened breakable segment 32, on its inner wall, it has a plurality of engaging elements 39 and with an encapsulator 41, which is defined as being a radially continuous portion whose inner diameter is slightly larger than the outer diameter of the middle section 14. In its outer side wall the upper portion 113 of the activation ring 88 preferably has texture or corrugation in order to be easier for the user to manipulate.

The keys 84 consist of rigid elements to be inserted into the cavities 93, blocking the downward movement of the perfume atomizer, so that the geometry of the key can be varied, in the case of Example 4 key 84 is an element of cylindrical body of a rigid material L-shaped, that is to say, a cylindrical beam angulation of 90° or smaller diameters equal to the inner diameters of the cavities 93.

As for the decorative cap 86, this consists of a cylindrical cavity in which the upper end of the sleeve 85 is engaged and protects the applicator or atomizer 83 from accidental knocks or activation. The geometry of the exterior wall of the decorative cover 86 can vary and depends solely on the aesthetic design that the manufacturer wants to give it.

The use of the tamper-proof closure for sprayable liquid containers with disposable ring of Example 4 ensures that the atomizer cannot be activated if the tamper-proof closure is not previously activated and therefore will be evident to any user, by means of a visual inspection to know if the container has been opened for the first time or not. The user will receive the packaged product with the tamper-proof closure of example 4 in the pre-opening position in which the breakable elements 17 are visible to the naked eye.

To place the tamper-proof closure of example 4 in the pre-opening position, the manufacturer, once he has filled the container with the desired product, must seal the container as normally would do it with the perfume bottle, with the difference that after the metallic lockseam of the flange of the bottle and the base of the atomizer, the shirt 85 must be inserted so that it is axially coupled with the neck of the bottle and by means of pressure is firmly attached to the lockseam 90, so that it is not possible to detach the shirt 85 once placed without irreversibly damaging the bottle 89 and the elements that conform the closure. Once the shirt 85 has been inserted and fixed in the neck 5 around the lockseam 90, it is necessary that the keys 84 be inserted into the cavities 93 so that they are completely immersed therein, since the keys 84 are inserted into the cavities 93 so that they are completely immersed therein, once the pins 84 are placed in its positions, it is needed to insert the activation ring axially on the sleeve 85 with the breakable segment weakened 32 downwards as shown in [FIG. 15] so that the guide buttons 92 enter in alignment with the inlet 115 so that the buttons 92 abut the first flange 111, when in abutting said two elements it must be pressed axially downwards so that by elastic deformation of the guide button 92 passes over the ridge 111 and the tooth 116 to be contained between the flange 111 and the second flange 112.

The tooth 116 in the aforementioned position, guarantees that it is unable to return and exit through the entry end, and at the same time prevents the system from activating accidentally, since to continue activating the closure it is necessary to apply force in the direction descending as will be explained later.

Once the activating ring has been placed as explained, the closure is in the pre-opening position and the decorative cover 86 can be placed freely. At this point the breakable elements 17 are visible to the naked eye and although the decorative cover 86 can be removed, the keys 84 are blocking the movement of the atomizer 83, which prevents access to the product.

When an individual wish to have access to the product, the consumer must rotate the activation ring 88 counter-clockwise, which will generate a force in the downward direction thanks to the threaded coupling of the guide buttons 92 and the gutter 95. Said force in downward direction will cause an elastic deformation of the tooth 116 that will pass over the rim 112, once this happens the rotation of the activation ring 88 must continue until the engagement elements 39 come into contact with the initial support section 15, that with sufficient mechanical energy will generate an elastic deformation. The geometry of the coupling elements 39 allows that when passing through the initial support 15 they can no longer pass in the opposite direction, but when passing over the initial support 15 an instantaneous acceleration is generated that drives the encapsulation ring 41 against breakable elements 17, breaking them and encapsulating or capturing them in the isolation space 47.

At this point it is considered that the tamper-proof closure security example 4 is in activation position as shown in [FIG. 17], so the broken frangible elements 17 are visible through the frangible section 32 which is made of a transparent material, however, to access the product it is necessary to take post-opening position.

In order to take the closure of example 4 to the post-opening position, as shown in [FIG. 18], and to have access to the product, the latter must continue turning anti-clockwise once the closure is in the position of activation. This anti-clockwise rotation must be complemented with an upward movement in order that the guide buttons 92 continue to move along the channel 91, which will cause the weakened joints 33 to break and the upper portion 113 to detach from the breakable segment weakened 32. Once the guide buttons have exited the outlet end 114, the upper portion can be discarded, and at this time the keys 84 are free to be removed from their cavities 93, said keys being disposable so that once removed these they can be discarded. At this point it is considered that the closure of example 4 is in post-opening position and the consumer already has access to the product and can place and remove the decorative cover 86 as many times as required.

Tamper-Proof Closure Example 4

Tamper-Proof Closure for Containers with Snap-on Lids

The tamper-proof closure for containers with snap-on closure caps of example 4 can be seen in [FIG. 23] which is an exploded view of the elements that conform said closure which are; the container with prism geometry 117, an activation ring 118 and a lid 119 with prismatic geometry.

The container 117 is made of some material selected from the group of ceramics (eg, glass), which at its upper end has a neck 120, which unlike the container body (which is prismatic), has a body substantially cylindrical with coaxial walls on the x-axis, in which on its outer wall a plurality of engagement rims 121 distributed symmetrically and radially on an axis perpendicular to the x-axis are housed, which are defined as having a structure of right-triangle revolutionized in where virtually one of the legs is adjacent to the outer wall of the neck 120 and the other leg faces the lower portion of the container 117, as illustrated in [FIG. 23]. Below the lateral ends of the rims 121, two radial locking flanges 122 project for each rim 121 in the neck of the container. Immediately below said flanges 122 is a first ring 123, spaced apart from a second ring 124 by a distance equal to or greater than the thickness of the engaging elements 39.

A last ring 126 is positioned at a distance such that between the face 127 and the lower end of the ring 126 the distance is equal to the height of the ring 118.

Activation ring 118, [FIG. 25], is a body with substantially cylindrical walls around the x-axis which in its outer wall is smooth and a plurality of latching elements 39 and a fracturing ring 63 project into its interior wall, similar in structure and operation to those referred to in the tamper-proof closure of example 1.

The lid 119 of the closure of example 5, [FIG. 24], is characterized in that it can be of prismatic geometry and its external walls 128 are coaxial to the X axis, the upper end of the hollow prismatic body is closed by a wall of the same thickness than wall 128. The lid 119 is also provided with a central sealing ring 60, which is a hollow cylindrical body protruding from the face 130. Between the central sealing ring 60 and the walls 128 is housed a system ring 131 which is a cylindrical body coaxial to the x-axis, in this ring 131 is where a plurality of anchors 125 are housed.

To use the tamper-proof closure of Example 4, once the manufacturer has placed the product of interest in the container 117, the activation ring 118 must be placed on the neck 120 so that the engaging elements 39 are above the fracture ring 63 as can be seen in [FIG. 26], the ring 118 is inserted until the elements 39 interfere with the ring 123. At this time the lid must be inserted so that the flat faces of the lid 119 and the container 117 are aligned, this alignment will result in the anchors 125 being axially aligned with the engagement flanges 121, downward pressure is applied until the cap 119 undergoes an elastic deformation and the anchors 125 pass over the shoulders 121 and the flat faces of both elements are in contact, which results in the pre-opening position in which it cannot be removed. Likewise, the radial locking flanges 122 prevent the lid from rotating radially and being removed.

The pre-opening position is how the customer receives the product, in which it can be verified that the container has not been opened for the first time because the breakable elements 17 are intact and are visible to the naked eye. To having access to the product, the consumer have to apply a mechanical force in a downward direction on the X-axis so that the engaging elements 39 of the ring 118 suffer an elastic deformation such that they pass over the ring 124 and 126. At the moment when the elements 39 pass over the ring 126, they acquire an instantaneous acceleration such that the ring 118 projects in a downward direction breaking the breakable elements 17 in its path until it is braked by the upper face of the container 127 and the fragments corresponding to the breakable elements 17 are captured instantaneously in the insulation space 132, keeping the breakable elements 17 once fractured insulated to avoid that these can come to represent a risk for the consumer.

Once these events have taken place, the flat face of the elements 39 will prevent them from moving in an upward direction, in other words, they are irreversibly blocked. At this point it is considered that the closure is in the activation position, illustrated in [FIG. 27].

As seen in [FIG. 27], in the activation position the central sealing ring is elastically deformed due to a mechanical stress supplied in the direction towards the X-axis, this stress is a result of the design of the central sealing ring 60, which is positioned at a radial distance such as to generate an interference with the rim of the container 133, so that when the lid 119 is pressed downwards to activate the closure of Example 4, the interference generates an elastic deformation of the ring 60. So that as soon as it is turned either clockwise or counter-clockwise until the faces of the lid 119 and the container 133 are out of phase and when the pressure is removed, the lid is automatically projected upwards, signaling the user that he already has access to the contents of the container 117, at this point it is considered that the container is in post-opening position and the lid can be placed and removed as many times as necessary by the consumer.

Example 5

Tamper Evident Closure for Irregularly Shaped Containers

The tamper-proof closure for irregularly shaped containers of Example 5 can be seen in [FIG. 28], which is an exploded view of the elements that make up said closure, which are; the container of irregular geometry 134, a clamp 135, a plurality of provisional structures 136 and a lid 137 with the irregular geometry of the container 134.

The container 134 is made of some rigid material, which can be selected from the group of ceramics, plastics and thermoplastics, which at its upper end has a neck 138, which has the same irregular geometry as the lower body of the container 134 but with a reduction in dimensions, in which, on at least one outer wall, a plurality of wedge rims 140, a concavity 141 and a semicircular rim 142 are arranged symmetrically and horizontally distributed with respect to the axis perpendicular to the X axis, where the ridges 140 are defined as having a triangle-rectangle structure in order to serve as latching elements, while the ridges 142 have a rounded profile, as illustrated in [FIG. 28]. The breakable elements 17 are preferably between the last two wedge rims 140 as can be seen in [FIG. 31].

The provisional structures 136 are a plurality of elements, which are inserted between the lid 137 and the container 134, when the tamper-proof closure of Example 5 is in the pre-opening position. The function of the temporary structures 136 is to prevent an accidental activation of the closure when stowing or handling, in other words, the temporary structures 136 serve as safeguards preventing the lid 137 and the clamp 135 from moving downward by an applied force accidentally,] FIG. 30].

Clamp 135 comprises a portion of some rigid material, preferably transparent, which has the same irregular geometry of container 134, whose internal dimensions are equal or slightly larger and proportional to the outer walls of the neck 138 of container 134, whose outer walls can preferentially coincide with the outer walls of the lower portion 139 of the container 134, so that they are axially engageable, as can be seen in [FIGS. 28 and 31]. On the inside faces of the clamp 135, which, when coupled with the neck 138, are adjacent to the concavity 141, are the toothed tongues 147, which at their free end have a serrated structure in the form of a half arrowhead, as can be seen in [FIGS. 28 and 33]. It is also important to mention that the clamps are manufactured in such a way that the tongues 147 have an inclination toward the center of the ring, so that the tongues suffer an elastic deformation when they are coupled in the neck 138.

The lid 137 is defined as being a hollow body with the same irregular geometry as the container 134, whose upper end is closed, while on the inner face 143 of the closed end of the lid, a central sealing body is located and it seals tightly with the inner wall of the container's mouth, likewise, on the inner faces of the lid there are a plurality of blocking elements 146, adjacent to the faces were the flanges 140 and 142 are [FIGS. 31 and 32].

Optionally, the tamper-proof closure of Example 5 may have auxiliary guides 150 for axial coupling of the clamp 135 and the lid 137 with the neck 138, so that said guides 150 prevent uneven axial coupling.

To use the tamper-proof closure of example 5, once the manufacturer has filled the container with the product of interest, the clamp 135 must be axially engaged until the tongue 147 is below the ridge 140 closest to the flange of the opening of the container, at this point the activating flange 149 will be between the second and third flange 140, which keeps the clamp in its position, allowing a downward movement but not rising thanks to the geometry of the flanges 140 and of the tongue 147. The lid 137 can be placed simultaneously with the clamp 135, or it can be placed after the clamp is placed. The lid 137 cannot be removed because the tongue has a hook wedge at its free end, which interacts with the locking elements 146 of the lid. Optionally, structures 136 can be placed below the clamp 135 to prevent accidental activation of the system.

When completing the steps described above, the closure will be in the pre-opening position, as can be seen in [FIG. 31]. In [FIG. 31] it can also be observed that in the open position the breakable elements 17 are visible to the naked eye, which allows to carry out an inspection that let know to the consumer that the container has not been opened since its original filling.

To have access to the product the consumer must bring the system to its activation position, for which it is necessary that the temporary structures 136 be removed in order to be able to apply an axial force in a downward direction that allows the lid 137 to push the clamp 135, so that the activating flange 149 passes over the third flange or ridge 140, breaking the breakable element 17, passing through the third and last flange 140 to terminate on the semicircular ledge 142, capturing the breakable element(s) 17, leading to the activation position, [FIG. 32].

Finally, in order to access the content of the product, the lid 137 is removed, giving rise to the post-opening position, which can be removed and placed indefinitely without affecting the normal use of the container tamper-proof closure of the closure of the Example 5

Example 6

Tamper-Proof Closure for Sprayable Liquid Containers with Mono-Piece Lid.

The Tamper-proof closure for sprayable liquid containers of mono-piece lid of Example 6 bases its operating principle on the tamper-proof closure system of the present invention, and has the advantage of being applicable, but not limitingly, in products like perfumes with atomizer. This has the advantage that the lid is a single monolithic piece and the use of the system requires a short or almost null learning curve because the consumer will open the container as any conventional container would open.

The closure of Example 6 is characterized by being formed of a bottle 151, a lockseamed mechanism 152, a latch 153 and a single monolithic lid 154.

The bottle 151 has a neck characterized in that, adjacent to its upper end where the opening for pouring the product is, there is the engaging portion 171 which in turn has a plurality of gutters 158. Below the engaging portion 171, there is an increase in diameter which results in the formation of a final support ridge 164, which is additionally a little larger than the intermediate portion 172, in order that the ridge 164 be a little larger than the diameter of the portion 172, another diameter increase is given below the final support ridge 164, resulting in the support surface 163. However, in the portion 172, comprised between the surface 163 and the ridge 164, the breakable elements 17 are housed.

The lockseamed mechanism 152 is characterized as being a hollow body of substantially cylindrical walls projecting coaxially to the X axis, with its upper axial end closed except for a hole 159 intended to house the mechanism of the atomizer 162. In its inner side walls, two ridges or lockseam latches 156 are housed, while in its outer side walls there is located, in its upper portion, a locking flange 169, and in its middle section the complementary locking thread 157, the complementary locking thread 157 is formed by a plurality of steps, which consist of a plurality of threads angularly separated from one another, as can be seen in [FIGS. 33 and 34].

The single monolithic cap 154 comprises a substantially tubular monolithic hollow part, which preferably is made of some rigid material, and which extends along the X-axis between an open axial end and a closed axial end. The cap 154 has a substantially cylindrical wall around the X axis, which is divided into a weakened breakable lower portion 160 and an upper portion or cap portion 161, divided by a weakened breakable connection 65. On the inner wall of the single monolithic cap 154, in its weakened breakable lower portion 160, is a blocking thread 170, a latching flange 166 and a fracturing ring 165.

In order to use the security locking closure of Example 6, as indicated by the description of the system on which the closure is based and same as that described above in this document, it is necessary that the consumer receives the container in the position of opening, take it to the activation position and remove the lid to take it to the post-opening position to access the product. In order to bring the closure to the pre-opening position, once the bottle 151 has been filled with the product of interest, manually or automatically, the lockseam 152 must be inserted, which will be mechanically hooked thanks to the lockseam latches 156 being trapped between the blocking gutters 158 of the neck 168 of the bottle 151. The lockseam 152 has a hole 159 intended to house the atomizer and the mechanism thereof necessary for the dosing of the product. Once the lockseam 152 has been placed, a latch 153 is placed in the free space between the atomizer 162 and the upper face of the lockseam 152, this safe fulfills the function of preventing accidental activation of the atomizer 162.

After the coupling of the latch 153 as described above, the single monolithic cap 154 is placed by an axial coupling, force is applied in a downward direction, until the latching flange 166 passes over the locking flange 169 when an elastic deformation occurs of them and of the walls of the single monolithic lid 154. At this point the threads of the blocking thread 170, due to gravity, rest on the threads of the complementary locking thread 157. Carried out the steps above, the tamper-proof closure of Example 6 is in the pre-opening position [FIG. 36], where the breakable elements 17 are visible, allowing any person to verify that the product has not been open yet.

When the consumer wishes to access the contents of the bottle 151, he must bring the Tamper-proof closureof Example 6 to the activation position and subsequently to the post-opening position. To bring the closure to the activation position, the consumer must make a counter-clockwise rotation, as he would intuitively do to open any common container. By doing the rotation as described, a downward movement is generated which will induce an elastic deformation of the fracturing ring 165 that will allow it to pass over the final support ridge 164, which in turn thanks to the potential energy resulting from the elastic deformation will produce an instantaneous acceleration sufficient to push the single monolithic cap 154 and its fracturing ring 165, in a downward direction to break the breakable elements 17 continue its displacement until the support surface 163 stops said displacement and the breakable elements remain encapsulated in the encapsulation space 167, at this point it is considered that the closure is in the activated position.

Conveniently the latch 153 prevents the single monolithic lid 154 from involuntarily activating the atomizer at the time when the lid descends to activate the system. To finally bring the closure to the post-opening position, the anti-clockwise rotation must continue, which will cause the threads 157 and 170 to interfere and stop the movement, which will generate a mechanical tension in the weakened joint 65 and to detachment of cap portion 161 from weakened breakable portion 160.

Once the atomizer 162 is discovered, the latch 153 must be removed and at this moment the closure is in the post-opening position and the consumer can have access to the product with the possibility of placing and removing the lid as many times as necessary.

Finally, it should be understood that the system and the examples of closure s based thereon described and illustrated herein, may be subject to modifications and variants that do not depart from the scope of the appended claims.

Best Way to Carry Out the Invention: Single-Piece Tamper-Proof Closure for Liquid Bottles.

The mono-piece tamper-proof closure for liquid bottles is the best way to carry out the invention, illustrated in [FIG. 9], it is another way of applying the tamper-proof closure system for containers, in the case of this closure is also suitable for use in beverage bottles and/or alcoholic beverages. The mono-piece tamper-proof closure for beverage bottles of the best way to carry out the invention comprises a single monolithic piece 53 and a bottle 54 with a neck 55, which interacts with the single monolithic piece 53.

The single monolithic piece 53 comprises a substantially tubular monolithic hollow part, which preferably is made of some plastic material, and which extends along the x axis between an open axial end 56 and a closed axial end 57. The piece 53 has a substantially cylindrical wall around the x-axis, which has three different diameters along the body of the piece 53, the upper portion of said piece having the smaller diameter followed by the lower one and being the largest diameter the third lower section of the piece 53.

The part 53 is in turn divided into a lid portion 76 and a section corresponding to a weakened breakable ring. An inner thread 59, a locking thread 61 and a fracture ring 63 are housed in the inner wall 58 of the part 53 in its lid portion 76.

The locking thread 61 is formed by a plurality of steps, which consist of a plurality of reversed threads 81 angularly spaced from one another. The threads 81 are small portions of yarn arranged symmetrically on the perimeter of the inner wall 58.

The single monolithic part 53 in its lid portion 76 is also provided with a central sealing ring 60, which is a hollow cylindrical body projecting from the face 80 and is coaxial with the inner wall 58, the central sealing ring 60 it is accommodated in its post-opening and pre-opening position at the open end of the bottle 54 so as to promote a hermetic seal without the need for the face 80 to be pressed against the edge 88 to generate a hermetic seal.

Conveniently the neck 55 of the bottle 54 has a thread 71, a complementary reverse thread 69, an initial support ridge 67, a plurality of breakable elements 68 and a final support ring 70.

The complementary reverse thread 69 of the bottle 54 is formed by a plurality of advancements, which consist of a plurality of reverse threads 82 angularly spaced from one another, which is located into the side wall section comprised above the initial support ridge 67 up to the immediate upper diameter reduction of the side wall of the bottle 54.

Below the thread 69, perpendicular to the x axis are located; the initial support ridge 67, the breakable elements 68 and finally the final support ring 70.

In order to use the tamper-proof closure for beverage bottles of the closure of the best manner of carrying out the invention, described as above, at the moment in which the bottle 54 has been filled with the original product of the manufacturer, it is necessary that the neck 55 of the bottle 54 is axially aligned with the single monolithic piece 53 so that the piece 53 can be inserted into the neck 55, so that the central sealing ring 60 engages the inner wall 66 of the bottle 54. Said coupling must generate sufficient pressure between the wall 66 and the ring 60 so that the closure of the bottle 54 is airtight.

The vertical coupling of the piece 53 is given until the thread 59 and the thread 71 are causing an interference, once the interference between the mentioned elements occurs, a radial turning movement must be carried out in a clockwise direction, that is to say, the movement to close most commercial bottles. This rotation forms a threaded coupling between the bottle 54 and the piece 53, which generates a downward axial movement. In the last portion of this trajectory the threads 69 and 81, which are parallel, meet and when they are parallel they do not generate a threaded coupling, but they generate an interference with the totality of their walls in simultaneous contact.

Conveniently the thread 81 and the ring 62 are made of an elastic material that at the time when mechanical force derived from the torque of the threaded coupling of the threads 59 and 71 continues to be supplied, an elastic deformation occurs in the thread 81 that allows it to pass on thread 69, made of vitreous material, without rupture or permanent deformation of any element of the closure. Once the threads that conform the thread 81 have passed over the steps of the thread 69, a characteristic "click" or sound pulse is produced, which indicates that the cover is in the pre-opening position, just as is illustrated in [FIG. 13]. The downward movement of the part 53 that is generated when turning clockwise is automatically blocked upon completion of the events described above by interference of the fracture ring 63 and the initial support ridge 67.

It can also be seen in [FIG. 13] that the tamper-proof closure for beverage bottles of the best embodiment of the invention in its pre-opening position has a hermetic seal thanks to the central sealing ring 60 which presses against the inner wall of the bottle 66, which generates a sufficient pressure to seal the bottle hermetically. Likewise, the threaded coupling that occurs between the piece 53 and the bottle 54 provides the necessary blocking so that the weight of the content of the bottle does not move the piece 53 out of its position and spills or contaminates the content.

Once the product is sold, the consumer receives the bottle with the tamper evident closure in the pre-opening position, in which the breakable elements 68 are visible, the final consumer can verify at a glance inspection that the bottle has not been opened since its closed in the factory, verifying that the breakable elements 68 are intact.

When the consumer wants to have access to the contents of the bottle, he must rotate piece 53 counter-clockwise as he would with any bottle. In doing so, the reverse thread 81 and the reverse thread 69, in threaded engagement, generate a force in the downward direction, which generates an accumulation of kinetic energy between the fracture ring 63 and the initial support ridge 67. This accumulated kinetic energy generates that at a given moment, the wedge-shaped faces allow an elastic deformation of the ring 63 that when passing over the ridge 67 triggers an instantaneous acceleration that pulls the ring 63 toward the breakable elements 68 causing its instantaneous rupture, at the same time as the breakable elements are encapsulated in the annular space 75 defined by the outer wall of the bottle, the lower axial portion of the ridge 67, the final support ring 70 and the inner wall of the weakened breakable ring 62, same on which the fracture ring 63 is defined, upon finishing the events described above the position of activation of the system results.

Once the previously described events have been concluded, the threaded coupling between the threads 57 and 71 is propitiated, which, by continuing to turn counterclockwise, generates an upward movement. Because the ring 64 and ridge 67 prevent any upward displacement, at the time of twist in that direction it fractures the weakened joint 65, detaching or separating the weakened breakable ring 62 from the lid portion 76. Conveniently the weakened breakable ring 62 is made of some transparent vitreous material which allows to observe the breakable elements effectively detached from the bottle and free in space 75, while the lid portion 76 can be used to close or open the bottle as many times as consumer requires it.

INDUSTRIAL APPLICABILITY

The present invention refers to a tamper-proof closure system and closures for containers that can be applied in any type of container that is desired to protect against piracy and adulteration, preferably it is applied, due to the rigidity properties, in containers made of rigid materials that can be selected from the group of ceramic materials, plastics and thermoplastics.

PATENT BIBLIOGRAPHY patcit1: Patent Application US20050011855A1
patcit2: Patent Application EP2769927 A1
patcit3: Patent EP1981774 B1
patcit4: Patent Application US20120091091A1
patcit5: U.S. Pat. No. 3,165,220A
patcit6: Patent EP0722890B1

The invention claimed is:

1. A tamper-proof closure system for containers comprising;

a. A neck with a thread and a plurality of breakable elements;

b. a ring or mechanical element for an encapsulation; and c. a threaded lid that interacts with a corresponding threaded portion of the bottle in such a way that makes it evident at a glance that the container has been opened for the first time by breaking the breakable elements and encapsulating them with the ring or mechanical element for encapsulation wherein the lid has a removable or independent section which has the function of encapsulating the breakable elements once the system is activated.

2. The tamper-proof closure system for containers of claim 1 wherein its operation is divided into three stages;

a) Pre-opening position; which is the position in which the consumer receives a product once a producer has sealed the container, in which the only way to open the container is by activating the tamper-proof closure system since a design prevents the lid from being removed without carrying the system to activation and post-opening position, b) Activation position; is where the system has been activated by the consumer when opening the container for the first time, but it has not yet completed an uncovering process and there is still no access to the product inside the container, this is a position that results when finishing a downward movement of the lid, moment in which the breakable elements are fractured and captured simultaneously and, c) Post-opening position; is where a separation of the lid and the ring through which the breakable elements, once fractured and detached, will be encapsulated in the activation position and the container can be opened and closed as many times as the consumer needs.

3. The tamper-proof closure system for containers of claim 1 wherein the breakable elements are protruding segments, at the perimeter of the neck of the container designed to be susceptible to rupture.

4. The tamper-proof closure system for containers of claim 1 wherein the lid is the mechanical piece that, when interacting with the neck keeps the container closed and is an element for application of the mechanical energy that requires the system to be used and further includes a mechanism for generating a first and a single downward displacement and then an upward movement.

5. The tamper-proof closure system for containers of claim 1 wherein a detachable section of the lid houses the mechanical structures that carry out the fracture of the frangible elements and its subsequent encapsulation.

6. The tamper-proof closure system for containers of claim 5, further comprising a mechanism contained in the detachable section which engages the container structure during the vertical downward movement of the container at the time the breaking of the frangible element is performed, the trapping of the frangible elements is carried out in a cavity formed by the detachable section and an outer surface of the container.

7. The tamper-proof closure system of claim 1, comprising;

a) a bottle (2) with; a neck (5) which is the part next to the open side of the bottle; a plurality of breakable elements (17); a screw portion (9), adjacent to the opening of the container which is provided with an external thread (10), an anchoring mechanism (11) which is a ridge on the outer side wall along the x axis, a radially continuous outer annular collar (12) positioned on the outer side wall, and a securing section (16), B) an inner monolithic part (3), which has the function of generating a seal for retaining the contents of the container and is further conformed of; an external thread (21); an internal thread (22); a latching flange (23); a plurality of at least two radial rotating brakes (24); an assembly guide (34); and a closed axial end (25) and an upper surface (26), C) an outer monolithic part (4) comprising a monolithic hollow part preferably of some plastic material, substantially tubular and which extends along the x axis between an open axial end (27) and a closed axial end (28) and has a substantially cylindrical and smooth sidewall around the x axis in turn said part is formed from; an upper lid segment (31) which engages the inner monolithic part and a weakened breakable segment (32), containing the mechanism for fracturing the breakable elements of the neck of the bottle, which is connected and joined to; the upper segment of cover (31), by a plurality of circumferential junctions (33) perpendicular to the X axis were are located the assembly guide (34), an irreversible latching mechanism (36) which at their free end have a wedge-shaped termination, in which an inclined plane is defined (37), a flat blocking surface (43), an inverted internal thread (30), and a radial tooth (38).

8. The tamper-proof closure system of claim 1, comprising;

a) a bottle (151) comprising; a neck; with and engaging portion (171), gutters (158), final support ridge (164), intermediate portion (172), breakable elements (17)

b) a single monolithic cap (154) divided in two portions by a weakened breakable connection (65); the first a weakened breakable lower portion (160) comprising a blocking thread (170), a latching flange (166) and a fracturing ring (165); and the second an upper portion or cap portion (161)

c) a lockseamed mechanism (152); which is a hollow body of substantially cylindrical walls projecting coaxially to the X axis, with its upper axial end closed except for a hole (159), in its inner side walls two ridges or lockseam latches (156) are housed, while in its outer side walls there is located, in its upper portion, a locking flange (169), and in its middle section, the complementary locking thread (157) that is formed by a plurality of steps, which consist of a plurality of threads angularly separated from one another.

9. A tamper-proof closure for containers of cosmetics with independent ring derived from the system of claim 1, comprising;

a) a lid (99); comprising a substantially tubular monolithic hollow part between an open axial end (56) and a closed axial end (57), a central sealing ring (60), container thread (105), radial brakes (107) and a central sealing ring (60), b) a container (97); which has three different outer walls, the wall (102), (103) and (104), each one of them corresponding to the different diameters; a complementary locking thread (69); an initial support ridge (67); and the breakable elements (17); between the outer side wall (103) and (104) a final support surface is defined; a complementary locking thread (69);

c) an independent ring (94); comprising a cylindrical hollow part of internal diameter equal to or slightly larger than the outer side wall (103) and the outer side wall of the independent ring (94) should be in its lower part a diameter greater than the inner diameter of the base of the lid (99), and in its upper portion smaller than the diameter of the inner wall of the lid (99); locking thread (61); radial brakes (108); a fracture ring (63).

10. The tamper-proof closure system of claim 1, comprising;

A) a container (117); made of ceramics, which at its upper end has a neck (120), and has a body substantially cylindrical with coaxial walls on the x-axis, in which on its outer wall a plurality of; engagement rims (121) distributed symmetrically and radially on an axis perpendicular to the x-axis are housed; two radial locking flanges (122) project for each rim (121) in the neck of the container, immediately below said flanges (122) is a; first ring (123), spaced apart from a; second ring (124) by a distance equal to or greater than the thickness of the; engaging elements (39); a last ring (126) is positioned at a distance such that between the face (127) and the lower end of the ring (126), B) an activation ring (118); defined by being a body with cylindrical walls which on its outer wall thereof and in its inner wall a plurality of latching elements (39) and a fracturing ring (63) are projected, C) a lid (119); defined with prismatic geometry and the upper end of the hollow prismatic body is closed, the lid is also provided with a central sealing ring (60), which is a hollow cylindrical body projecting from the face (130), while between the central sealing ring (60) and walls (128) a system ring (131) is housed which is a cylindrical body coaxial to the x axis in which a plurality of anchors (125) are housed.

11. The tamper-proof closure system of claim 1, comprising;

A) a container, made of ceramics, plastic and thermoplastic, which at its upper end has a neck (138), which has the same irregular geometry as the lower body of the container but with a reduction in dimensions, in which, on at least one outer wall, a plurality of wedge rims (140) are housed, a concavity (141) and a semicircular rim (142) distributed symmetrically and horizontally with respect to the axis perpendicular to the x axis, where the rims (140) are defined as having a triangular triangle structure for the purpose of serving as engaging elements, the rims (142) are provided with a rounded profile, while the breakable elements (17) are preferably between the latter two wedge rims;

B) a provisional structures, are a plurality of elements, which are inserted between the lid (137) and the container (134), preventing an accidental activation of the closure when stowing or handling, C) clamp (135); comprises a portion of some rigid material, preferably transparent, which has the same irregular geometry of container (134), whose internal dimensions are equal or slightly larger and proportional to the outer walls of the neck (138) of container (134), whose outer walls can preferentially coincide with the outer walls of the lower portion (139) of the container (134), so that they are axially engageable, on the inside faces of the clamp (135), are the toothed tongues (147), which at their free end have a serrated structure in the form of a half arrowhead, D) lid (137); it is defined as being a hollow body of the same irregular geometry as the container and it is intended to be able to use the invention the container and whose upper end are closed, while on the inner face (143) of the closed end of the lid, a central sealing body is located and it seals tightly with the inner wall of the container's neck, likewise, on the inner faces of the lid (137) there are a plurality of blocking elements (146), adjacent to the faces were the flanges 140 and 142 are.

12. A tamper-proof closure for sprayable liquid containers with mono-piece lid derived from the system of claim 1, comprising;

A) a bottle (151); which is defined by counting with a neck, which, adjacent to its upper end where the opening for pouring the product is found, the engaging portion (171) which in turn has a plurality of gutters (158), conveniently below the engaging portion, an increase in diameter is given which leads to the formation of a final support ridge (164), which in turn is slightly larger than the portion (172) in order that the ridge (164) be a little larger than the diameter of the portion (172), another diameter increase is given below the final support ridge (164), resulting in the support surface (163) However, in the portion (172), comprised between the surface (163) and the ridge (164), the breakable elements (17) are housed, b) A lockseamed mechanism (152); characterized as being a hollow body of substantially cylindrical walls projecting coaxially to the X axis, with its upper axial end closed except for a hole (159) intended to house the mechanism of the atomizer (162), in its inner side walls; two ridges or lockseam latches (156) are housed, while in its outer side walls there is located, in its upper portion a locking flange (169), and in its middle section the complementary locking thread (157), this complementary locking thread (157) is formed by a plurality of steps, which consist of a plurality of threads angularly separated from one another, C) a single monolithic cap (154), comprising; a substantially tubular monolithic hollow part, which preferably is made of some rigid material, and which extends along the X-axis between an open axial end and a closed axial end; a cap (154) that has a substantially cylindrical wall around the X axis, which is divided into a weakened breakable lower portion (160) and an upper portion or cap portion (161), divided by a weakened breakable connection (65), on the inner wall of the single monolithic cap (154), in its weakened breakable lower portion (160), is a; blocking thread (170), a latching flange (166) and a fracturing ring (165), D) a latch (153); capable of being placed in the free space between the atomizer 162 and the upper face of the lockseam 152.

* * * * *